US006994046B2

(12) United States Patent
Kaji et al.

(10) Patent No.: US 6,994,046 B2
(45) Date of Patent: Feb. 7, 2006

(54) MARINE VESSEL RUNNING CONTROLLING APPARATUS, MARINE VESSEL MANEUVERING SUPPORTING SYSTEM AND MARINE VESSEL EACH INCLUDING THE MARINE VESSEL RUNNING CONTROLLING APPARATUS, AND MARINE VESSEL RUNNING CONTROLLING METHOD

(75) Inventors: Hirotaka Kaji, Shizuoka (JP); Masaru Suemori, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 15 days.

(21) Appl. No.: 10/969,640

(22) Filed: Oct. 20, 2004

(65) Prior Publication Data

US 2005/0092225 A1 May 5, 2005

(30) Foreign Application Priority Data

Oct. 22, 2003 (JP) ..... 2003-361459
Oct. 22, 2003 (JP) ..... 2003-361460

(51) Int. Cl.
*B63H 25/00* (2006.01)

(52) U.S. Cl. ..... 114/144 R; 440/53

(58) Field of Classification Search ..... 114/144 R, 114/144 E, 151; 440/53, 84; 701/21
See application file for complete search history.

(56) References Cited

U.S. PATENT DOCUMENTS

| | | | | |
|---|---|---|---|---|
| 3,715,571 | A * | 2/1973 | Braddon | 114/144 R |
| 4,009,678 | A * | 3/1977 | North | 114/144 R |
| 6,234,853 | B1 * | 5/2001 | Lanyi et al. | 440/53 |
| 2004/0106337 | A1 | 6/2004 | Okabe | |

FOREIGN PATENT DOCUMENTS

| | | |
|---|---|---|
| JP | 62-167938 | 7/1987 |
| JP | 01-285486 | 11/1989 |
| JP | 02-227395 | 9/1990 |
| JP | 2000-313398 | 11/2000 |
| JP | 2001-152897 | 6/2001 |
| JP | 2001-265406 | 9/2001 |
| JP | 2004-175309 | 6/2004 |

* cited by examiner

*Primary Examiner*—Lars A. Olson
(74) *Attorney, Agent, or Firm*—Keating & Bennett, LLP

(57) ABSTRACT

A marine vessel running controlling apparatus controls running of a marine vessel and includes a pair of propulsion systems which respectively generate propulsive forces on a rear port side and a rear starboard side of a hull, and a pair of steering mechanisms which respectively change steering angles defined by directions of the propulsive forces with respect to the hull. The apparatus includes a target combined propulsive force acquiring section, a target movement angle acquiring section, a steering controlling section which controls the steering angles of the respective steering mechanisms such that a turning angular speed of the hull is substantially equal to a predetermined target angular speed, a target propulsive force calculating section which calculates target propulsive forces to be generated from the respective propulsion systems based on the target combined propulsive force, the target movement angle and the steering angles of the respective steering mechanisms, and a propulsive force controlling section which controls the respective propulsion systems so as to attain the target propulsive forces.

17 Claims, 13 Drawing Sheets

MARINE VESSEL RUNNING CONTROLLING APPARATUS, MARINE VESSEL MANEUVERING SUPPORTING SYSTEM AND MARINE VESSEL EACH INCLUDING THE MARINE VESSEL RUNNING CONTROLLING APPARATUS, AND MARINE VESSEL RUNNING CONTROLLING METHOD

BACKGROUND OF THE INVENTION

1. Field of the Invention

The present invention relates to a marine vessel running controlling apparatus which is applicable to a marine vessel having at least one pair of propulsion systems provided at a stern thereof, a marine vessel maneuvering supporting system and a marine vessel each including the marine vessel running controlling apparatus, and a marine vessel running controlling method.

2. Description of the Related Art

When a marine vessel travels toward or away from a wharf, a lateral maneuvering operation is performed to laterally move the hull of the marine vessel with the angular speed (stem turning speed) of the hull maintained constant (for example, at zero). In general, large-scale marine vessels include a plurality of small propulsion systems called "side thrusters" provided at a stem and other locations of a hull to laterally move the hull. The side thrusters each generate a propulsive force in a lateral direction of the hull. Thus, the hull can be laterally moved toward and away from the wharf by operating the side thrusters.

However, small-scale marine vessels, such as cruisers or boats, rarely include side thrusters because side thrusters cause various problems, such as an increase in costs, a need to modify the design of the hull to accommodate for installation of the side thrusters, and an increase in fuel consumption due to an increase in drag of the hull.

Cruisers and other leisure marine vessels are often operated by unskilled beginners. However, the lateral maneuvering of the small-scale marine vessels having no side thruster is very difficult, thereby requiring skills.

To this end, a marine vessel maneuvering apparatus which includes port-side and starboard-side propulsion systems provided at a stern of a marine vessel for facilitating the lateral maneuvering operation is disclosed, for example, in Japanese Patent No. 2810087. Japanese Patent No. 2810087 further discloses a mechanism for adjusting the orientation of the port-side and the starboard-side propulsion systems in accordance with each other, and a mechanism for operating engine throttles of the port-side and the starboard-side propulsion systems in accordance with each other. More specifically, the marine vessel maneuvering apparatus orients the port-side and starboard-side propulsion systems toward the center of the hull and generates a forward propulsive force from one of the propulsion systems and a reverse propulsive force from the other propulsion system.

However, the marine vessel maneuvering apparatus is not designed to calculate the directions and magnitudes of the propulsive forces required to be generated by the port-side and starboard-side propulsion systems for laterally moving the marine vessel in a desired direction. Therefore, the operator must manually operate the marine vessel for the lateral maneuvering operation to laterally move the marine vessel parallel, and thus must have a certain level of skill.

Further, the small-scale marine vessels are more likely to be influenced by disturbances than the large-scale marine vessels. More specifically, the instantaneous center (instantaneous rotation center) of the hull observed when the marine vessel is turned is easily changed by static disturbances such as the number and positions of passengers and the weight and positions of cargoes. Further, the instantaneous center is changed by dynamic disturbances such as winds and waves.

However, the prior art disclosed in Japanese Patent No. 2810087 is based on the assumption that the instantaneous center is fixed. Therefore, no consideration is given to the aforementioned disturbances. In reality, the lateral maneuvering operation for laterally moving the marine vessel toward and away from the wharf requires a substantial level of skill even with this prior art.

SUMMARY OF THE INVENTION

To overcome the problems described above, preferred embodiments of the present invention provide a marine vessel running controlling apparatus which facilitates maneuvering of a marine vessel, and a marine vessel maneuvering supporting system and a marine vessel each including the marine vessel running controlling apparatus.

Other preferred embodiments of the present invention provide a marine vessel running controlling method which facilitates the maneuvering of a marine vessel.

A marine vessel running controlling apparatus according to one preferred embodiment of the present invention includes a pair of propulsion systems which respectively generate propulsive forces on a rear port side and a rear starboard side of a hull, and a pair of steering mechanisms which respectively change steering angles defined by directions of the propulsive forces generated by the respective propulsion systems with respect to the hull. The apparatus includes a target combined propulsive force acquiring section which acquires a target combined propulsive force to be applied to the hull by the pair of propulsion systems, a target movement angle acquiring section which acquires a target movement angle defined by a target movement direction of the hull with respect to a stem direction of the hull, a steering controlling section which controls the steering angles of the respective steering mechanisms such that a turning angular speed of the hull is substantially equal to a predetermined target angular speed, a target propulsive force calculating section which calculates target propulsive forces to be generated from the respective propulsion systems based on the target combined propulsive force acquired by the target combined propulsive force acquiring section, the target movement angle acquired by the target movement angle acquiring section and the steering angles of the respective steering mechanisms, and a propulsive force controlling section which controls the respective propulsion systems so as to attain the target propulsive forces calculated by the target propulsive force calculating section.

With this arrangement, the steering angles of the respective steering mechanisms are controlled such that the angular speed of the hull is substantially equal to the predetermined target angular speed. In this state, the propulsive forces of the respective propulsion systems are controlled based on the target combined propulsive force, the target movement angle and the steering angles, whereby the hull is moved at the target movement angle by the target combined propulsive force. Where the target angular speed is set at zero, for example, the hull is moved parallel without turning the stem thereof.

This makes it possible to perform a lateral maneuvering operation without skill. For example, even an unskilled operator can easily maneuver the marine vessel to laterally move the marine vessel toward or away from a wharf. Further, when the operator wants to move the marine vessel by a very small distance for changing a fishing point (for so-called trolling) or to stop the marine vessel at a fixed position against a tidal current or a wind during fishing, the orientation of the hull can easily be maintained. Thus, the maneuvering of the marine vessel is greatly facilitated.

If the instantaneous center (instantaneous rotation center) of the hull is considered to be fixed, the steering angles of the respective steering mechanisms maybe set at constant values according to the target angular speed. More specifically, if the target angular speed is zero, the steering angles of the respective steering mechanisms may be determined such that action lines along which the propulsive forces are generated by the respective propulsion systems intersect each other at the instantaneous center. In this case, the steering angles are determined based on geometrical information related to the hull and the propulsion systems. The geometrical information includes, for example, positions of the respective propulsion systems relative to the instantaneous center. In this case, the relative positions may be defined by the positions of the respective propulsion systems with respect to a center line of the hull extending through a stem and a stern of the hull (distances between the center line and propulsive force generating positions at which the propulsive forces are generated) and a distance from the instantaneous center to a midpoint between the propulsive force generating positions of the respective propulsion systems.

The instantaneous center is located, for example, on the center line of the hull. For example, the respective propulsion systems generate the propulsive forces at positions that ere symmetrical with respect to the center line. In this case, the steering angles of the respective steering mechanisms may be determined so as to be symmetrical with respect to the center line.

The marine vessel is preferably a relatively small-scale marine vessel such as a cruiser, a fishing boat, a water jet or a watercraft.

The propulsion systems may be in the form of an outboard motor, an inboard/outboard motor (a stern drive) an inboard motor, or a water jet drive. The outboard motor includes a propulsion unit provided outboard and having a motor and a propulsive force generating member (propeller), and a steering mechanism which horizontally turns the entire propulsion unit with respect to the hull. The inboard/outboard motor includes a motor provided inboard, and a drive unit provided outboard and having a propulsive force generating member and a steering mechanism. The inboard motor includes a motor and a drive unit provided inboard, and a propeller shaft extending outward from the drive unit. In this case, a steering mechanism is separately provided. The water jet drive is such that water sucked from the bottom of the marine vessel is accelerated by a pump and ejected from an ejection nozzle provided at the stern of the marine vessel to provide a propulsive force. In this case, the steering mechanism includes the ejection nozzle and a mechanism for turning the ejection nozzle in a horizontal plane.

The target combined propulsive force to be acquired by the target combined propulsive force acquiring section is preferably input from a target propulsive force inputting section to be operated by an operator. Similarly, the target movement angle to be acquired by the target movement angle acquiring section is preferably input from a target movement angle inputting section to be operated by the operator. More specifically, the target propulsive force inputting section and the target movement angle inputting section are preferably provided in the form of a joy-stick type operation device. The operation device preferably includes an upright lever that is inclinable in any desired direction which is designed to output the degree of the inclination of the lever (an inclination angle with respect to a neutral position) as a target propulsive force signal and output the direction of the inclination of the lever as a movement angle signal. The target movement angle is preferably an angle defined between the target movement direction of the hull and the stem direction along the center line of the hull.

Where the propulsion systems each include a motor (particularly an engine), the propulsive force controlling section preferably controls throttle opening degrees of the engines of the respective propulsion systems according to the target propulsive forces. More specifically, the propulsive force controlling section preferably includes a target engine speed calculating section which calculates target engine speeds according to the target propulsive forces, and a throttle opening degree controlling section which controls the throttle opening degrees so as to attain the calculated target engine speeds.

The marine vessel running controlling apparatus preferably further includes an angular speed detecting section which detects the turning angular speed of the hull. In this case, the steering controlling section preferably includes a target steering angle calculating section which calculates target steering angles of the respective steering mechanisms such that the turning angular speed detected by the angular speed detecting section is substantially equal to the target angular speed.

With this arrangement, even if the instantaneous center of the hull fluctuates, the hull can be moved in a desired direction with the target angular speed maintained constant. Therefore, the lateral maneuvering operation is easily performed despite disturbances attributable to variations in onboard loads, waves and winds.

In this case, the target propulsive force calculating section preferably calculates the target propulsive forces by using the target steering angles calculated by the target steering angle calculating section as the steering angles of the respective steering mechanisms. In addition, a steering angle detecting section which detects at least one of the steering angles of the steering mechanisms is preferably provided. That is, the target propulsive force calculating section calculates the target propulsive forces based on the steering angle detected by the steering angle detecting section.

The target steering angle calculating section preferably calculates the target steering angles of the respective steering mechanisms such that the action lines along which the propulsive forces are generated by the respective propulsion systems intersect each other on the center line extending through the stem and the stern of the hull.

With this arrangement, the steering angles of the port-side and starboard-side steering mechanisms are symmetrically set with respect to the center line. Therefore, the steering angles are easily controlled.

Preferably, the target steering angle calculating section calculates one of the target steering angles of the steering mechanisms by adding a constant $\phi_c$ to a steering angle correction value $\psi$ ($\psi>0$) and calculates the other target steering angle by subtracting the constant $\phi_c$ from the steering angle correction value $\psi$ when an action point defined by an intersection of the action lines is located outside the center line.

With this arrangement, the target steering angles of the respective steering mechanisms are determined by determining the steering angle correction value ψ, such that the computation for the control is simplified. When the steering angle correction value ψ is ψ=0, the action point is located on the center line of the hull.

If the action point is located apart from the propulsion systems on a stem side, increased propulsive forces should be generated from the respective propulsion systems to laterally move the hull. However, each of the propulsion systems is limited in their capability to generate propulsive force. If it is difficult to generate the propulsive forces in desired directions even with the action point being located in a predetermined range on the center line, the generation of the desired propulsive forces is facilitated by locating the action point outside the center line by setting the steering angle correction value to a value other than zero.

The target steering angle calculating section preferably includes a basic target steering angle storing section which stores a basic target steering angle, a steering angle deviation computing section which computes a steering angle deviation based on a deviation of the angular speed detected by the angular speed detecting section from the target angular speed, and an adding section which adds the steering angle deviation computed by the steering angle deviation computing section to the basic target steering angle stored in the basic target steering angle storing section.

With this arrangement, the target steering angles for attaining the target angular speed are promptly and accurately set.

The basic target steering angle is preferably determined based on predetermined geometrical information related to the hull and the pair of propulsion systems. The predetermined geometrical information includes information regarding a design instantaneous center position of the marine vessel including the hull and the propulsion systems or an instantaneous center position obtained by actual measurement.

The steering angle deviation computing section is preferably a PI (proportional integration) controlling section which is operative based on input of an actual angular speed of the hull and the target angular speed.

The apparatus preferably further includes a writing section which writes an output of the adding section as a new basic target steering angle in the basic target steering angle storing section at predetermined times.

With this arrangement, the basic target steering angle is updated whenever necessary. Therefore, a basic target steering angle which has been determined in consideration of influences of static disturbances, such as variations of the onboard loads, is stored in the basic target steering angle storing section. Thus, the angular speed of the hull can be rapidly set to the target angular speed after the control is started.

The output of the adding section to be written in the basic target steering angle storing section may be, for example, an output provided at completion of the control. In this case, the timing for writing the new basic target steering angle in the basic target steering angle storing section is preferably immediately after the completion of the control.

The marine vessel running controlling apparatus preferably further includes a target angular speed acquiring section which acquires the target angular speed of the hull. In this case, the target steering angle calculating section preferably calculates the target steering angles of the respective steering mechanisms such that the turning angular speed detected by the angular speed detecting section is substantially equal to the target angular speed acquired by the target angular speed acquiring section.

With this arrangement, the target steering angles of the respective steering mechanisms are automatically determined according to the target angular speed, such that the target angular speed can be set at any level within a predetermined range. More specifically, the target angular speed to be acquired by the target angular speed acquiring section may be input from a target angular speed inputting section to be operated by the operator. Thus, the hull can be moved in the target movement direction while being turned at the target angular speed input by the operator. The target angular speed inputting section is preferably operative to set the target angular speed at zero. Thus, the hull can be moved parallel while maintaining the orientation of the stem unchanged by setting the target angular speed at zero.

Where the propulsion systems each include a motor as a drive source, the target propulsive force calculating section preferably includes a first rotational speed setting section which determines a rotational speed of the motor of one of the propulsion systems according to the target combined propulsive force acquired by the target combined propulsive force acquiring section, and a second rotational speed setting section which determines a rotational speed of the motor of the other propulsion system according to the rotational speed determined by the first rotational speed setting section, the target movement angle acquired by the target movement angle acquiring section and at least one of the steering angles of the steering mechanisms.

With this arrangement, the rotational speed of the motor of the one propulsion system is determined according to the target combined propulsive force, and the rotational speed of the motor of the other propulsion system is correspondingly determined according to the target movement angle and the steering angle. Thus, the hull can be moved in the target movement direction, for example, by operating the motors at rotational speeds corresponding to the target combined propulsive force by the operator. This suppresses or prevents the uncomfortable or unnatural feeling that may otherwise occur when the motors are operated at high rotational speeds in spite of a smaller target combined propulsive force.

The motors may be engines (internal combustion engines), electric motors or other suitable types of motors.

The target angular speed may be set at zero. In this case, the hull can be moved parallel maintaining the orientation of the stem unchanged.

The marine vessel running controlling apparatus preferably further includes a pair of trim mechanisms which respectively change trim angles defined by the directions of the propulsive forces generated by the respective propulsion systems with respect to a horizontal plane, and a trim angle controlling section which controls the trim mechanisms so as to equalize the trim angles of the respective propulsion systems with each other.

With this arrangement, the propulsive forces are generated at the same trim angle by the port-side and starboard-side propulsion systems, such that the control of the propulsive forces and the steering angles is facilitated.

A marine vessel maneuvering supporting system according to one preferred embodiment of the present invention includes the aforementioned marine vessel running controlling apparatus, a target propulsive force inputting section for inputting the target combined propulsive force to be acquired by the target combined propulsive force acquiring section, and a target movement angle inputting section for inputting the target movement angle to be acquired by the target movement angle acquiring section.

With this arrangement, a propulsive force having a magnitude and a direction that is input by the operator can be generated. Therefore, even an unskilled operator can easily move the hull.

Another marine vessel maneuvering supporting system according to a preferred embodiment of the present invention includes the aforementioned marine vessel running controlling apparatus, a target propulsive force inputting section for inputting the target combined propulsive force to be acquired by the target combined propulsive force acquiring section, a target movement angle inputting section for inputting the target movement angle to be acquired by the target movement angle acquiring section, and a target angular speed inputting section for inputting the target angular speed to be acquired by the target angular speed acquiring section.

With this arrangement, a propulsive force having a magnitude and a direction that is input by an operator can be generated, and the stem of the hull can be turned at a stem turning speed that is input by the operator. Therefore, even an unskilled operator can perform high-level marine vessel maneuvering operations.

A marine vessel according to a preferred embodiment the present invention includes a hull, a pair of propulsion systems which respectively generate propulsive forces on a rear port side and a rear starboard side of the hull, a pair of steering mechanisms which respectively change steering angles defined by directions of the propulsive forces generated by the respective propulsion systems with respect to the hull, and a marine vessel running controlling apparatus including the aforementioned features.

In this marine vessel, the steering angles of the respective steering mechanisms are controlled such that the angular speed of the hull is substantially equal to the predetermined target angular speed. In this state, the hull is moved at the target movement angle. Thus, an otherwise difficult marine vessel maneuvering operation, such as a lateral maneuvering operation, is easily performed.

A marine vessel running controlling method according to a preferred embodiment of the present invention is a method for controlling running of a marine vessel that includes a pair of propulsion systems which respectively generate propulsive forces on a rear port side and a rear starboard side of a hull, and a pair of steering mechanisms which respectively change steering angles defined by directions of the propulsive forces generated by the respective propulsion systems with respect to the hull. The method includes the steps of acquiring a target combined propulsive force to be applied to the hull by the pair of propulsion systems, acquiring a target movement angle defined by a target movement direction of the hull with respect to a stem direction of the hull, controlling the steering angles of the respective steering mechanisms such that a turning angular speed of the hull is substantially equal to a predetermined target angular speed, calculating target propulsive forces to be generated from the respective propulsion systems based on the target combined propulsive force, the target movement angle and the steering angles of the respective steering mechanisms, and controlling the respective propulsion systems so as to attain the calculated target propulsive forces.

In this method, an otherwise difficult marine vessel maneuvering operation, such as a lateral maneuvering operation, is easily performed without substantial operator skill.

The steering angle controlling step preferably includes the step of determining the target steering angles of the respective steering mechanisms such that action lines along which the propulsive forces are generated by the respective propulsion systems intersect each other on a center line of the hull extending through a stem and a stern of the hull. Thus, control of the steering angles is facilitated.

The steering angle controlling step preferably further includes the step of calculating one of the target steering angles of the steering mechanisms by adding a constant $\phi_c$ to a steering angle correction value $\psi$ ($\psi>0$), calculating the other target steering angle by subtracting the constant $\phi_c$ from the steering angle correction value $\psi$, and locating an action point defined by an intersection of the action lines outside the center line. In this method, a limitation due to limited output capabilities of the propulsion systems is mitigated, such that the lateral maneuvering operation can be performed to move the marine vessel in an increased angular range.

Each of the propulsion systems preferably includes a motor as a driving source. In this case, the target propulsive force calculating step preferably includes a first rotational speed setting step in which a rotational speed of the motor of one of the propulsion systems is determined according to the target combined propulsive force, and a second rotational speed setting step in which a rotational speed of the motor of the other propulsion system is determined according to the rotational speed determined in the first rotational speed setting step, the target movement angle and at least one of the steering angles of the steering mechanisms.

In this method, the motors are driven at rotational speeds that are in accordance with the target combined propulsive force by an operator and a crew. This ensures a satisfactory marine vessel maneuvering operation, and improves boarding comfort during the lateral maneuvering operation.

The foregoing and other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
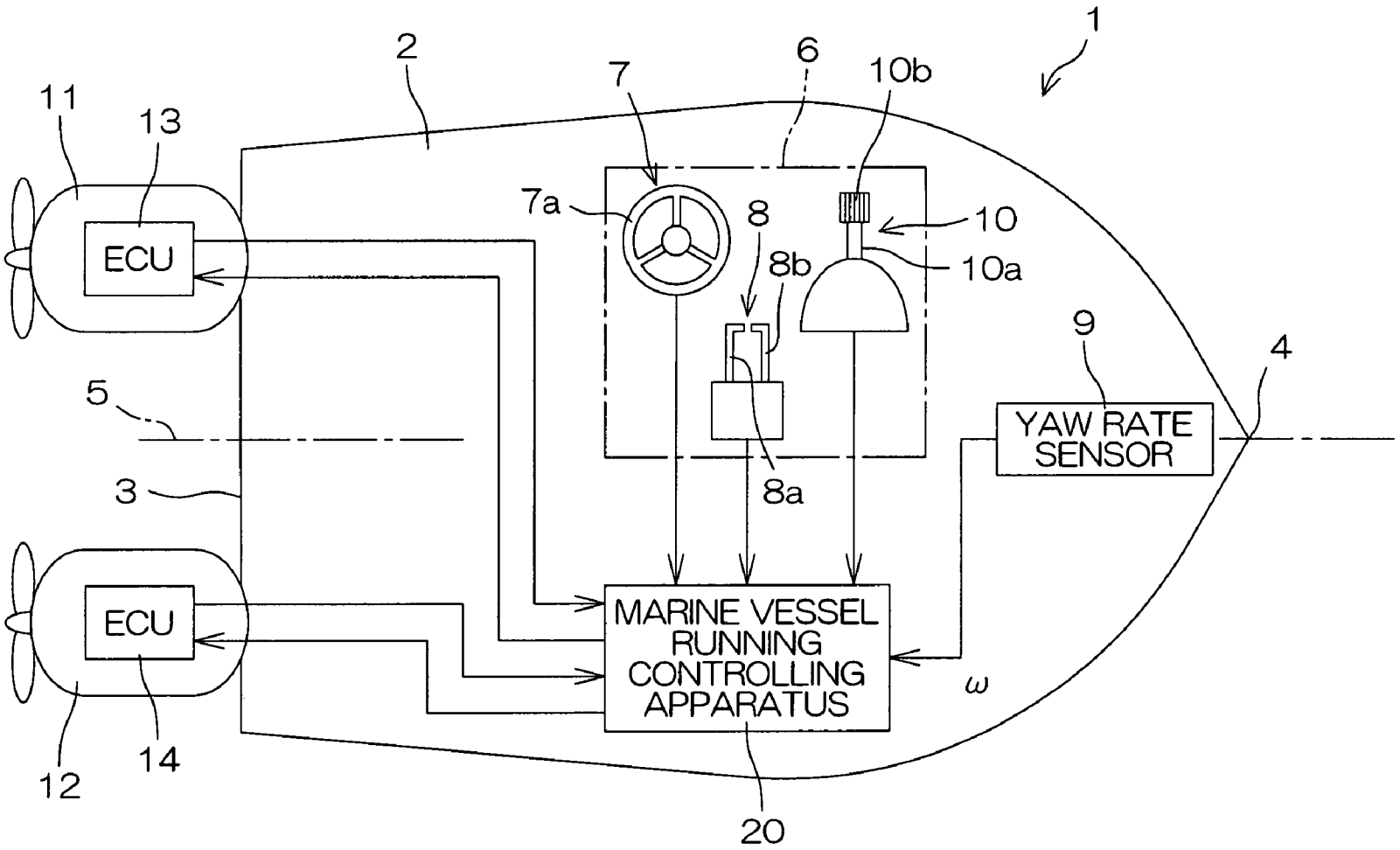
FIG. 1 is a schematic diagram illustrating a marine vessel according to one preferred embodiment of the present invention.

FIG. 1 is a schematic diagram illustrating a marine vessel 1 according to one preferred embodiment of the present invention. The marine vessel 1 is a relatively small-scale marine vessel, such as a cruiser or a boat, and includes a pair of outboard motors 11, 12 attached to a stern (transom) 3 of a hull 2. The outboard motors 11, 12 are positioned laterally symmetrically with respect to a center line 5 of the hull 2 extending through the stern 3 and a stem 4 of the hull 2. That is, the outboard motor 11 is attached to a rear port-side portion of the hull 2, while the outboard motor 12 is attached to a rear starboard-side portion of the hull 2. The outboard motor 11 and the outboard motor 12 will hereinafter be referred to as "port-side outboard motor 11" and "starboard-side outboard motor 12", respectively, to differentiate therebetween. Electronic control units 13 and 14 (hereinafter referred to as "outboard motor ECU 13 " and "outboard motor ECU 14 ", respectively) are incorporated in the port-side outboard motor 11 and the starboard-side outboard motor 12, respectively.

The marine vessel 1 includes a control console 6 for controlling the marine vessel 1. The control console 6 includes, for example, a steering operational section 7 for performing a steering operation, a throttle operational section 8 for controlling the outputs of the outboard motors 11, 12, and a lateral movement operational section 10 (defining a target combined propulsive force acquiring section and a target movement angle acquiring section). The lateral movement operational section 10 is for laterally moving the marine vessel 1, while keeping a constant turning angular speed of the marine vessel 1 (stem turning speed is kept at zero, for example). The steering operational section 7 includes a steering wheel 7*a*. The throttle operational section 8 includes throttle levers 8*a*, 8*b* for the port-side outboard motor 11 and the starboard-side outboard motor 12. In this preferred embodiment, the lateral movement operational section 10 is defined by a joystick type input device which includes an upright operation lever 10*a* (defining a target propulsive force inputting section and a target movement angle inputting section) and a stem turning speed adjusting knob 10*b* (defining a target angular speed inputting section) rotatably provided on the top of the operation lever 10*a*.

The operational signals of the operational sections 7, 8, 10 provided on the control console 6 are input as electric signals to a marine vessel running controlling apparatus 20, for example, via a LAN (local area network, hereinafter referred to as "inboard LAN") provided in the hull 2. The marine vessel running controlling apparatus 20 includes an electronic control unit (ECU) including a microcomputer, and functions as a propulsive force controlling apparatus for propulsive force control and as a steering controlling apparatus for steering control. A yaw rate sensor 9 (angular speed detecting section) for detecting the angular speed (yaw rate or stem turning speed) of the hull 2 outputs an angular speed signal, which is also input to the marine vessel running controlling apparatus 20 via the inboard LAN.

The marine vessel running controlling apparatus 20 communicates with the outboard motor ECUs 13, 14 via the inboard LAN. More specifically, the marine vessel running controlling apparatus 20 acquires engine speeds (rotational speeds of motors) NL, NR of the outboard motors 11, 12 and steering angles $\phi L$, $\phi R$ of the outboard motors 11, 12 indicating the orientations of the outboard motors 11, 12 from the outboard motor ECUs 13, 14. The marine vessel running controlling apparatus 20 applies data including target steering angles $\phi L_t$, $\phi R_t$ (wherein a suffix "t" hereinafter means "target"), target throttle opening degrees, target shift positions (forward drive, neutral and reverse drive positions) and target trim angles to the outboard motor ECUs 13, 14.

In this preferred embodiment, the marine vessel running controlling apparatus 20 includes a control mode to be switched between an ordinary running mode in which the outboard motors 11, 12 are controlled according to the operations of the steering operational section 7 and the throttle operational section 8 and a lateral movement mode in which the outboard motors 11, 12 are controlled according to the operation of the lateral movement operational section 10. More specifically, the marine vessel running controlling apparatus 20 is operative in the ordinary running mode when an input from the steering operational section 7 or the throttle operational section 8 is detected, and is operative in the lateral movement mode when the operation of the lateral movement operational section 10 is detected.

In the ordinary running mode, the marine vessel running controlling apparatus 20 controls the outboard motors 11, 12 according to the operation of the steering wheel 7*a* such that the steering angles $\phi L$, $\phi R$ are substantially equal to each other. That is, the outboard motors 11, 12 generate propulsive forces that are parallel with each other. In the ordinary running mode, the marine vessel running controlling apparatus 20 determines the target throttle opening degrees and the target shift positions of the outboard motors 11, 12 according to the operation positions and directions of the throttle levers 8*a*, 8*b*. The throttle levers 8*a*, 8*b* are each inclinable forward and reverse. When an operator inclines the throttle lever 8*a* forward from a neutral position by a certain amount, the marine vessel running controlling apparatus 20 sets the target shift position of the port-side outboard motor 11 at the forward drive position. When the operator inclines the throttle lever 8*a* further forward, the marine vessel running controlling apparatus 20 sets the target throttle opening degree of the port-side outboard motor 11 according to the position of the throttle lever 8*a*. On the other hand, when the operator inclines the throttle lever 8*a* reverse by a certain amount, the marine vessel running controlling apparatus 20 sets the target shift position of the port-side outboard motor 11 at the reverse drive position. When the operator inclines the throttle lever 8*a* further reverse, the marine vessel running controlling apparatus 20 sets the target throttle opening degree of the port-side outboard motor 11 according to the position of the throttle lever 8*a*. Similarly, the marine vessel running controlling apparatus 20 sets the target shift position and the target throttle opening degree of the starboard-side outboard motor 12 according to the operation of the throttle lever 8*b*.

Upper portions of the throttle levers 8*a*, 8*b* are bent toward each other to constitute generally horizontal holders. With this arrangement, the operator can simultaneously operate the throttle levers 8*a*, 8*b* to control the outputs of the outboard motors 11, 12 with the throttle opening degrees of the port-side and starboard-side outboard motors 11, 12 maintained substantially the same.

In the lateral movement mode, the marine vessel running controlling apparatus 20 sets the target steering angles $\phi L_t$, $\phi R_t$, the target shift positions and the target throttle opening degrees of the port-side and starboard-side outboard motors 11, 12 according to the operation of the lateral movement operational section 10. A control operation to be performed in the lateral movement mode will be described in detail below.

Figure 2:
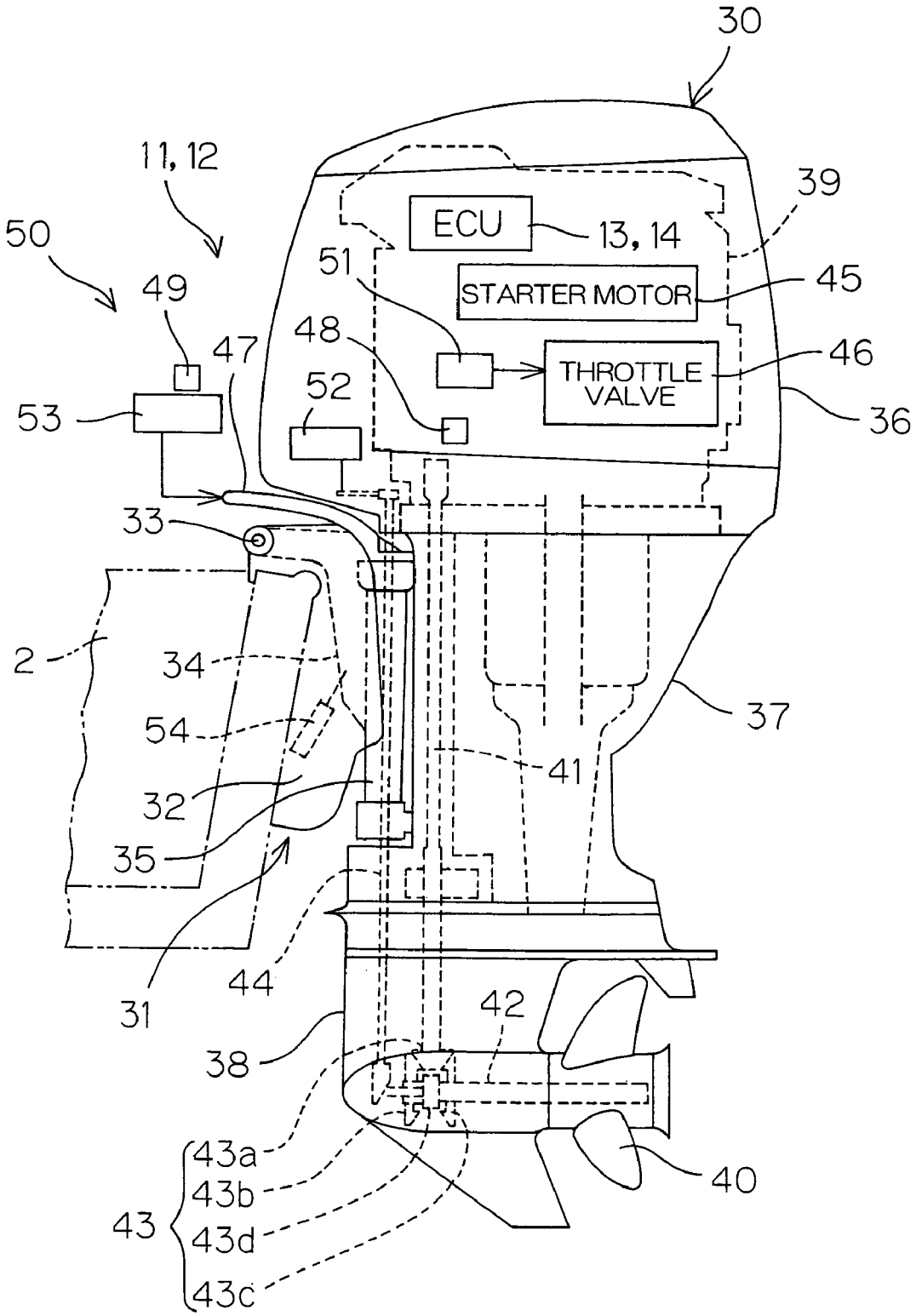
FIG. 2 is a schematic sectional view illustrating an outboard motor.

FIG. 2 is a schematic sectional view illustrating the common construction of the outboard motors 11, 12. The outboard motors 11, 12 each include a propulsion unit 30, and an attachment mechanism 31 for attaching the propulsion unit 30 to the hull 2. The attachment mechanism 31 includes a clamp bracket 32 detachably fixed to the transom of the hull 2, and a swivel bracket 34 connected to the clamp bracket 32 pivotally about a tilt shaft 33 (horizontal pivot axis The propulsion unit 30 is attached to the swivel bracket 34 pivotally about a steering shaft 35. Thus, the steering angle (which is equivalent to an angle defined by the direction of the propulsive force with respect to the center line of the hull 2) is changed by pivoting the propulsion unit 30 about the steering shaft 35. Further, the trim angle of the propulsion unit 30 (which is equivalent to an angle defined by the direction of the propulsive force with respect to a horizontal plane) can be changed by pivoting the swivel bracket 34 about the tilt shaft 33.

The propulsion unit 30 has a housing which includes a top cowling 36, an upper case 37 and a lower case 38. An engine 39 is provided in the top cowling 36 with an axis of a crank shaft thereof extending vertically. A drive shaft 41 for transmitting power is coupled to a lower end of the crank shaft of the engine 39, and vertically extends through the upper case 37 into the lower case 38.

A propeller 40 defining a propulsive force generating member is rotatably attached to a lower rear portion of the lower case 38. A propeller shaft 42 (rotation shaft) of the propeller 40 extends horizontally in the lower case 38. The rotation of the drive shaft 41 is transmitted to the propeller shaft 42 via a shift mechanism 43.

The shift mechanism 43 includes a beveled drive gear 43*a* fixed to a lower end of the drive shaft 41, a beveled forward drive gear 43*b* rotatably provided on the propeller shaft 42, a beveled reverse drive gear 43*c* rotatably provided on the propeller shaft 42, and a dog clutch 43*d* provided between the forward drive gear 43*b* and the reverse drive gear 43*c*.

The forward drive gear 43*b* is meshed with the drive gear 43*a* from a forward side, and the reverse drive gear 43*c* is meshed with the drive gear 43*a* from a reverse side. Therefore, the forward drive gear 43*b* and the reverse drive gear 43*c* rotate in opposite directions when engaged with the drive gear 43*a*.

On the other hand, the dog clutch 43*d* is in spline engagement with the propeller shaft 42. That is, the dog clutch 43*d* is axially slidable with respect to the propeller shaft 42, but is rotatable relative to the propeller shaft 42. Therefore, the dog clutch 43*d* is rotatable together with the propeller shaft 42.

The dog clutch 43*d* is slidable on the propeller shaft 42 by pivotal movement thereof about a shift rod 44 that extends vertically parallel to the drive shaft 41. Thus, the dog clutch 43*d* is shifted between a forward drive position at which it is engaged with the forward drive gear 43*b*, at a reverse drive position at which it is engaged with the reverse drive gear 43*c*, or at a neutral position at which it is not engaged with either the forward drive gear 43*b* or the reverse drive gear 43*c*.

When the dog clutch 43*d* is in the forward drive position, the rotation of the forward drive gear 43*b* is transmitted to the propeller shaft 42 via the dog clutch 43*d* with virtually no slippage between the dog clutch 43*d* and the propeller shaft 42. Thus, the propeller 40 is rotated in one direction (in a forward drive direction) to generate a propulsive force in a direction for moving the hull 2 forward. On the other hand, when the dog clutch 43*d* is in the reverse drive position, the rotation of the reverse drive gear 43*c* is transmitted to the propeller shaft 42 via the dog clutch 43*d* with virtually no slippage between the dog clutch 43*d* and the propeller shaft 42. The reverse drive gear 43*c* is rotated in a direction opposite to that of the forward drive gear 43*b*, as mentioned above. The propeller 40 is therefore rotated in an opposite direction (in a reverse drive direction). Thus, the propeller 40 generates a propulsive force in a direction for moving the hull 2 reverse. When the dog clutch 43*d* is at the neutral position, the rotation of the drive shaft 41 is not transmitted to the propeller shaft 42. That is, transmission of a driving force between the engine 39 and the propeller 40 is prevented, such that no propulsive force is generated in either of the forward and reverse directions.

A starter motor 45 for starting the engine 39 is connected to the engine 39. The starter motor 45 is controlled by the outboard motor ECU 13, 14. The propulsive unit 30 further includes a throttle actuator 51 for actuating a throttle valve 46 of the engine 39 in order to change the throttle opening degree to change the intake air amount of the engine 39. The throttle actuator 51 may be an electric motor. The operation of the throttle actuator 51 is controlled by the outboard motor ECU 13, 14. The engine 39 includes an engine speed detecting section 48 for detecting the rotation of the crank shaft to detect the engine speed NL, NR of the engine 39.

A shift actuator 52 (clutch actuator) for changing the shift position of the dog clutch 43*d* is provided in cooperation with the shift rod 44. The shift actuator 52 is, for example, an electric motor, and its operation is controlled by the outboard motor ECU 13, 14.

Further, a steering actuator 53 which includes, for example, a hydraulic cylinder and is controlled by the outboard motor ECU 13, 14 is connected to a steering rod 47 fixed to the propulsion unit 30. By driving the steering actuator 53, the propulsion unit 30 is pivoted about the steering shaft 35 for a steering operation. The steering actuator 53, the steering rod 47 and the steering shaft 35 define a steering mechanism 50. The steering mechanism 50 includes a steering angle sensor 49 for detecting the steering angle $\phi L$, $\phi R$.

A trim actuator (tilt trim actuator) 54 which includes, for example, a hydraulic cylinder and is controlled by the outboard motor ECU 13, 14 is provided between the clamp bracket 32 and the swivel bracket 34. The trim actuator 54 pivots the propulsion unit 30 about the tilt shaft 33 by pivoting the swivel bracket 34 about the tilt shaft 33. Thus, the trim angle of the propulsion unit 30 can be adjusted.

Figure 3:
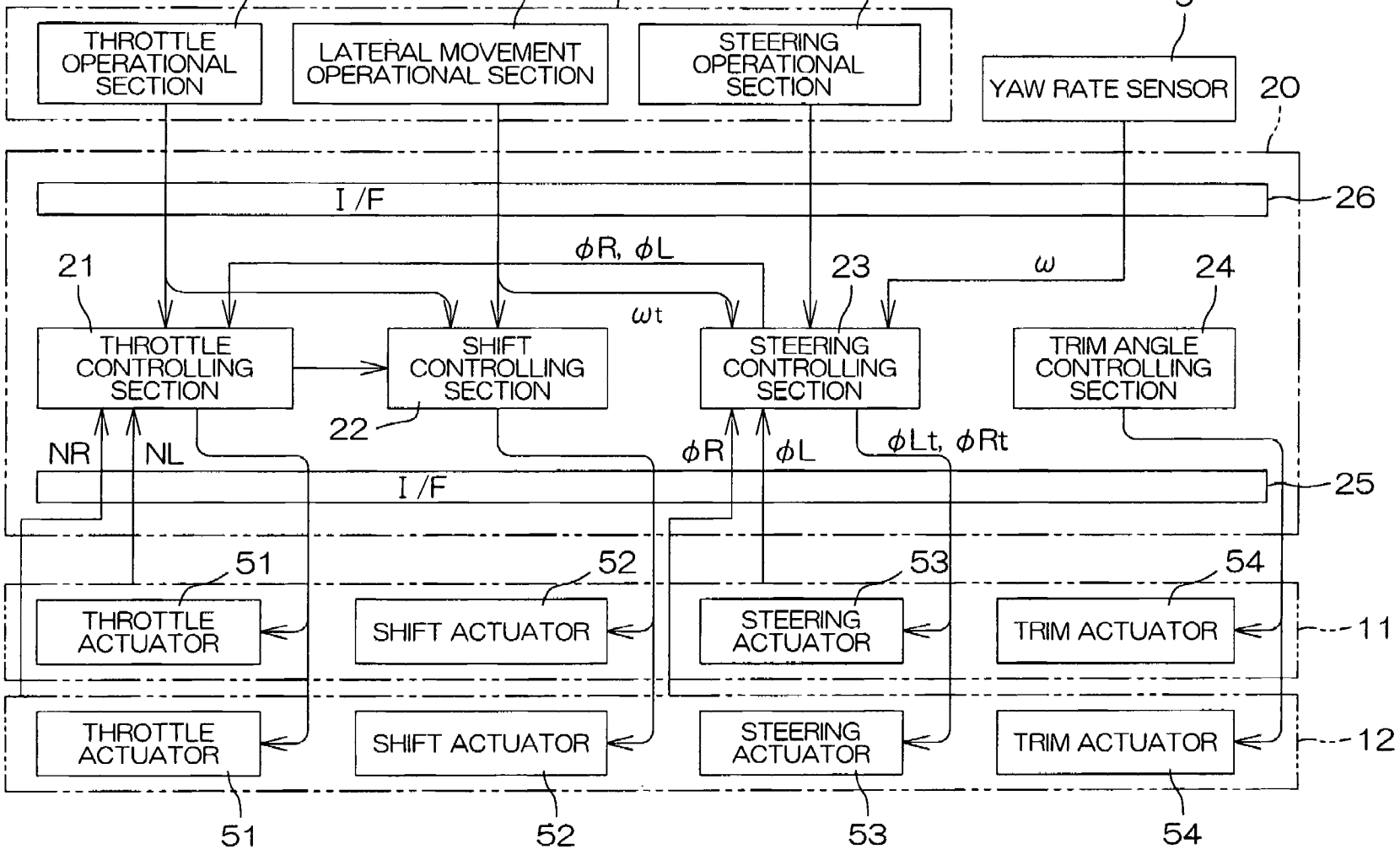
FIG. 3 is a block diagram illustrating a marine vessel running controlling system for controlling running of the marine vessel.

FIG. 3 is a block diagram illustrating a marine vessel maneuvering supporting system for controlling the running of the marine vessel 1. The marine vessel running controlling apparatus 20 includes a throttle controlling section 21 which issues command signals regarding the target throttle opening degrees for controlling the throttle actuators 51 of the port-side and starboard-side outboard motors 11, 12, a shift controlling section 22 (clutch controlling section) which issues command signals of the target shift positions for controlling the shift actuators 52 of the outboard motors 11, 12, a steering controlling section 23 which issues command signals of the target steering angles $\phi L_t$, $\phi R_t$ for controlling the steering actuators 53 of the outboard motors 11, 12, and a trim angle controlling section 24 which issues command signals of the target trim angles for controlling the trim actuators 54 of the outboard motors 11, 12. The functions of each of these controlling sections 21 to 24 may be provided by a predetermined software-based process performed by the microcomputer provided in the marine vessel running controlling apparatus 20.

The command signals generated by the respective controlling sections 21 to 24 are applied to the outboard motor ECUs 13, 14 via an interface (I/F) 25. The outboard motor ECUs 13, 14 control the actuators 51 to 54 based on the applied command signals.

The outboard motor ECUs 13, 14 respectively apply the engine speeds NL, NR detected by the engine speed detecting sections 48 and the steering angles $\phi L$, $\phi R$ detected by the steering angle sensors 49 to the marine vessel running controlling apparatus 20 via the interface 25. More specifically, the engine speeds NL, NR are applied to the throttle controlling section 21, and the steering angles $\phi L$, $\phi R$ are applied to the steering controlling section 23. The steering angles $\phi L$, $\phi R$ may also be applied to the throttle controlling section 21 from the steering controlling section 23. The target steering angles $\phi L_t$, $\phi R_t$ may be applied instead of the steering angles $\phi L$, $\phi R$ to the throttle controlling section 21 from the steering controlling section 23.

On the other hand, signals from the steering operational section 7, the throttle operational section 8, the yaw rate sensor 9 and the lateral movement operational section 10 are input to the marine vessel running controlling apparatus 20 via an interface (I/F) 26. More specifically, signals indicating the target steering angles $\phi L_t$, $\phi R_t$ are input from the steering operational section 7 to the steering controlling section 23. Signals indicating the magnitudes of the target propulsive forces are input from the throttle operational section 8 to the throttle controlling section 21, and signals indicating the directions of the propulsive forces are input from the throttle operational section 8 to the shift controlling section 22. The angular speed $\omega$ detected by the yaw rate sensor 9 is input to the steering controlling section 23.

Signals indicating a target combined propulsive force and a target movement angle (direction) are input from the lateral movement operational section 10 to the throttle controlling section 21, and a target angular speed $\omega_t$ set by the operation of the stem turning speed adjusting knob 10*b* is input from the lateral movement operational section 10 to the steering controlling section 23.

An intermittent shift command signal is also applied to the shift controlling section 22 from the throttle controlling section 21. Based on the intermittent shift command signal, the controlling section 22 performs an intermittent shift operation. In the intermittent shift operation, the shift controlling section 22 shifts the dog clutches 43*d* alternately between the neutral position and the forward drive position or between the neutral position and the reverse drive position. The intermittent shift operation is performed when the engine speeds for the target propulsive forces are lower than an idle speed of the engines 39 (a lower limit engine speed, for example, 700 rpm). The intermittent shift operation makes it possible to generate propulsive forces for engine speeds lower than the idle speed. The intermittent shift operation will be described in detail below.

Figure 4:
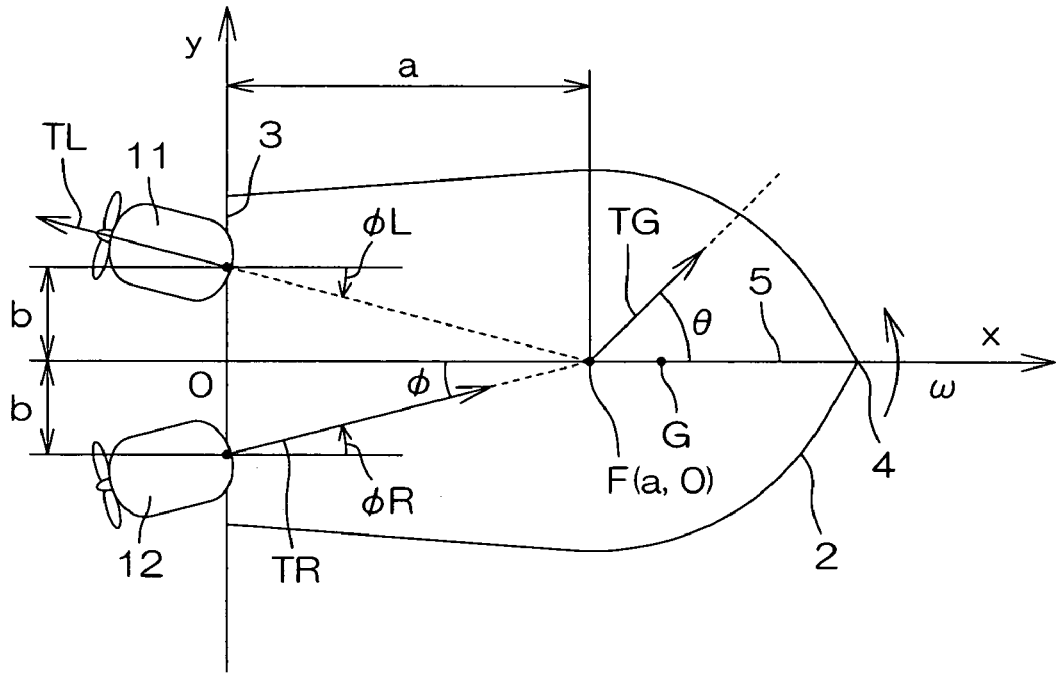
FIG. 4 is a diagram illustrating an operation for moving a hull in a lateral movement mode.

FIG. 4 is a diagram for explaining an operation for moving the marine vessel 1 in the lateral movement mode. A point at which the center line 5 of the hull 2 intersects the stern 3 is defined as an origin O. An axis extending along the center line 5 toward the stem 4 is defined as an x-axis, and an axis extending along the stern 3 (transom) toward the port side is defined as a y-axis. The origin O is a midpoint between propulsive force generating points at which the propulsive forces are generated by the respective propulsion units 30 provided in the outboard motors 11, 12.

In the lateral movement mode, the steering controlling section 23 sets the target steering angles $\phi L_t$, $\phi R_t$ of the port-side and starboard-side outboard motors 11, 12 such that action lines (indicated by broken lines) extending along vectors TL, TR of the propulsive forces generated by the respective outboard motors 11, 12 intersect each other in a predetermined location on the x-axis and the target angular speed $\omega_t$ is attained. At this time, the trim angle controlling section 24 controls the port-side and starboard-side outboard motors 11, 12 such that the trim angles of the respective outboard motors 11, 12 are substantially equal to each other so that horizontal components of the propulsive forces generated by the propulsion units 30 of the respective outboard motors 11, 12 are substantially equal to each other.

It is assumed that the intersection of the action lines of the propulsive force vectors TL, TR is defined as an action point F=(a,0) (wherein a>0), and the port-side and starboard-side outboard motors 11, 12 respectively generate the propulsive forces at positions (0, b), (0, −b) (wherein b is a constant value b>0) symmetrical with respect to the center line 5. If the steering angle $\phi R$ of the starboard-side outboard motor 12 is $\phi R=\phi$, the steering angle $\phi L$ of the port-side outboard motor 11 is expressed by $\phi L=-\phi$. Here, the angle $\phi$ is expressed by $\phi=\tan^{-1}(b/a)$.

A combined vector obtained by combining the propulsive force vectors TL, TR at the action point F is herein expressed by TG. The direction of the combined vector TG (which forms a movement angle $\theta$ with the x-axis) indicates the direction of the combined propulsive force (the movement direction of the hull 2), and the magnitude of the combined vector TG indicates the magnitude of the combined propulsive force. Therefore, it is necessary to direct the combined vector TG at the target movement angle $\theta_t$ (corresponding to the inclination direction of the operation lever 10*a*) applied from the lateral movement operational section 10 and to equalize the magnitude |TG| of the combined vector TG with the magnitude of the target combined propulsive force (corresponding to the inclination amount of the operation lever 10*a*) applied from the lateral movement operational section 10. In other words, target propulsive force vectors $TL_t$, $TR_t$ for the port-side and starboard-side outboard motors 11, 12 are determined so as to provide the aforementioned combined vector TG.

The simplest case is such that the action point F coincides with an instantaneous center G of the marine vessel 1. In this case, the angular speed $\omega$ of the hull 2 (angular speed about the instantaneous center G) is zero, so that the hull 2 laterally moves parallel with the orientation of the stem 4 being maintained unchanged.

Figure 5:
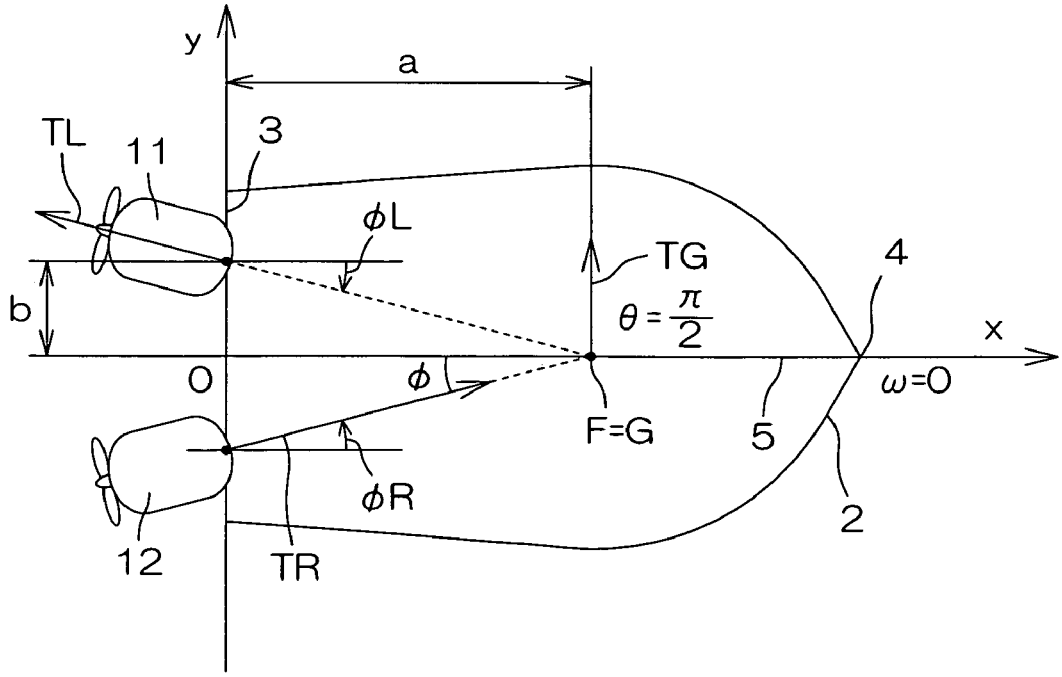
FIG. 5 is a diagram illustrating an operation for horizontally moving the hull perpendicularly to a center line of the hull.

More specifically, as shown in FIG. 5, the steering angles $\phi R$, $\phi L$ are set at $\phi R=\phi$, $\phi L=-\phi$ (wherein $\phi \geqq 0$) such that the action point F coincides with the instantaneous center G. At the same time, the port-side outboard motor 11 and the starboard-side outboard motor 12 generate the propulsive forces in the reverse drive direction and in the forward drive direction, respectively, so as to satisfy an expression $|TL|=|TR|$. At this time, the hull 2 is moved parallel leftward perpendicularly to a stem direction (perpendicularly to the centerline 5) with the orientation of the stem 4 kept unchanged. Thus, the marine vessel 1 can move toward or away from a wharf by the lateral maneuvering operation.

When the action point F does not coincide with the instantaneous center G (see FIG. 4), a rotation moment occurs around the instantaneous center G, such that the angular speed $\omega$ of the hull 2 is not equal to zero. In other words, when the target angular speed $\omega_t$ is set at a non-zero value by the stem turning speed adjusting knob 10*b* of the lateral movement operational section 10, the steering angles $\phi L$, $\phi R$ are controlled according to the target angular speed $\omega_t$ such that the action point F is offset from the instantaneous center G.

In reality, in this preferred embodiment, the steering angles $\phi L$, $\phi R$ are controlled such that the angular speed $\omega$ detected by the yaw rate sensor 9 is substantially equal to the target angular speed $\omega_t$. In this case, if the angular speed $\omega$ is $\omega=0$, the action point F coincides with the instantaneous center G with the instantaneous center G being located on the center line 5. If the angular speed $\omega$ is $\omega\neq0$, the action point F does not coincide with the instantaneous center G even with the instantaneous center G being located on the center line 5.

Figure 6:
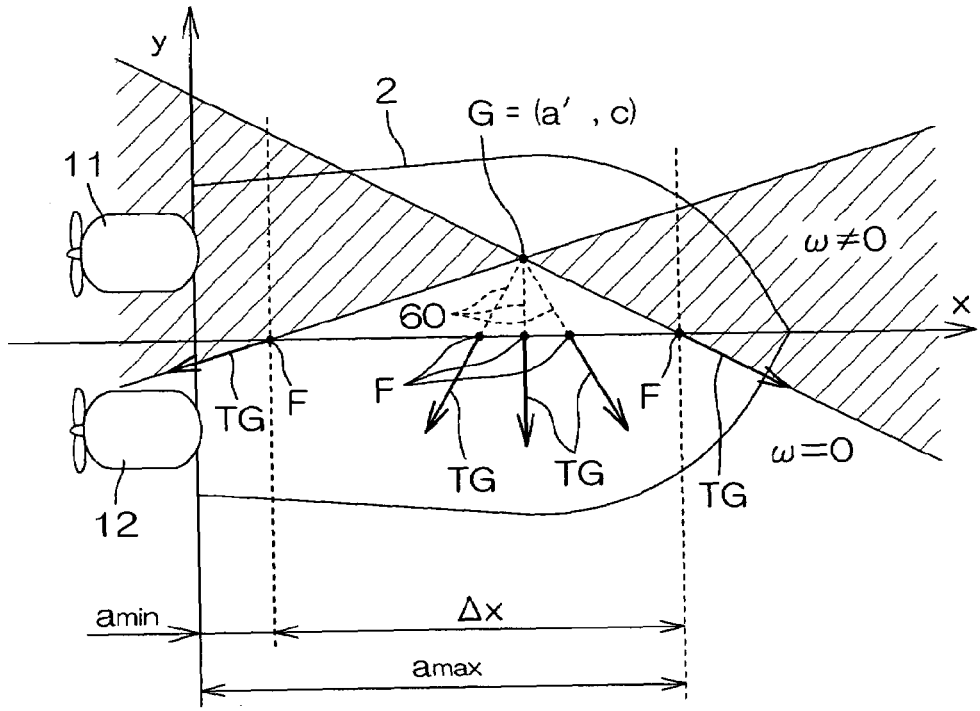
FIG. 6 is a schematic diagram for explaining a steering controlling operation.

FIG. 6 is a schematic diagram for explaining a specific operation for controlling the steering angles $\phi L$, $\phi R$. The instantaneous center G is not always located on the center line 5. In the case of the small-scale marine vessel 1, for example, the instantaneous center G changes when a crew member moves on the hull 2 or when fish are loaded into an under-deck water tank. Therefore, the position of the instantaneous center G is not limited to positions on the center line 5.

However, it is possible to perform the lateral maneuvering operation as desired with the action point F being located on the centerline 5, even if the instantaneous center G is not located on the center line 5. More specifically, a line 60 extending through the instantaneous center G at the target movement angle $\theta_t$ is drawn, and the action point F is located at an intersection of the line 60 and the center line 5. Then, the magnitudes of the propulsive force vectors TL, TR for the port-side and starboard-side outboard motors 11, 12 are determined so as to provide a combined propulsive force vector TG extending from the action point F along the line 60. Thus, the hull 2 can be moved parallel with the angular speed $\omega$ being kept at $\omega=0$.

The propulsion units 30 of the port-side and starboard-side outboard motors 11, 12 are pivotal only in a mechanically limited angular range about the steering shaft 35. Therefore, it is impossible, in reality, to locate the action point F within a range between the origin O and a predetermined lower limit point ($a_{min}$, 0) on the center line 5. Furthermore, if the action point F is located at a position more distant from the origin O than a predetermined upper limit point ($a_{max}$, 0) on the center line 5 to provide a desired combined vector TG extending laterally of the hull 2, greatly increased propulsive forces must be generated from the port-side and starboard-side outboard motors 11, 12. Therefore, the position of the action point F on the center line 5 is restricted within a range $\Delta x$ between the points ($a_{min}$, 0) and ($a_{max}$, 0) due to limitations in the steering angles of the propulsion units 30 and limitations in the output capabilities of the engines 39.

Where the instantaneous center G is located at a position (a', c) in FIG. 6, for example, the aforementioned limitations make it impossible to move the hull 2 parallel from the instantaneous center G into the cross-hatched ranges shown in FIG. 6 with the action point F being located on the center line 5. That is, it is impossible to set the angular speed $\omega$ at $\omega=0$, thereby imparting the hull 2 with a rotation moment.

Figure 7:
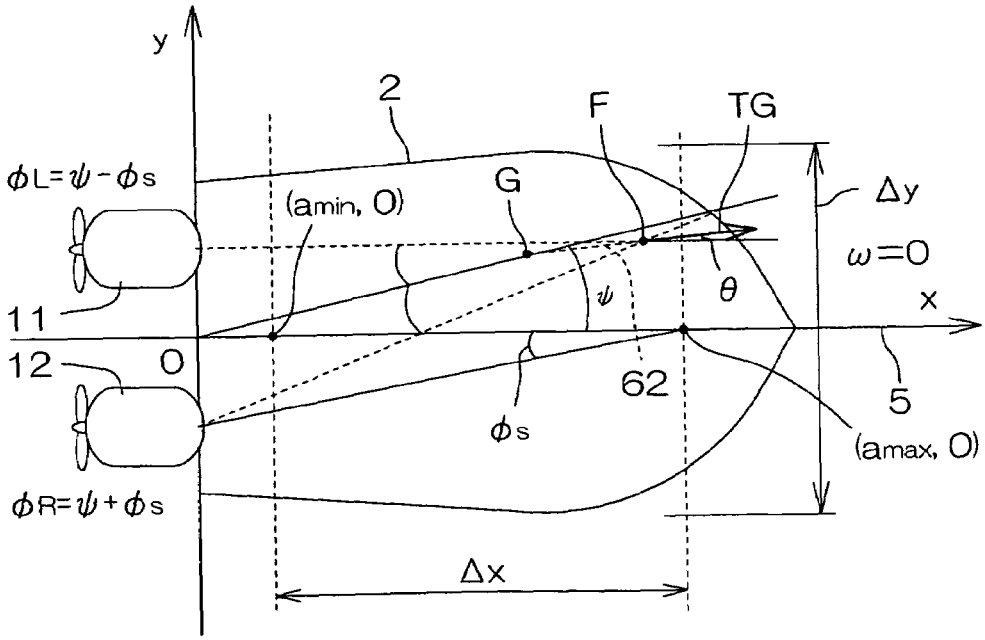
FIG. 7 is a schematic diagram for explaining the principle of an operation for locating an action point outside the center line.

That is, as shown in FIG. 7, there is a possibility that the angular speed $\omega$ cannot be set at $\omega=\omega_t$ (e.g., $\omega_t=0$) even if the steering angle $\omega R$ is reduced to a predetermined switching reference steering angle $\phi s$. When the steering angle $\phi R$ is reduced to the switching reference steering angle $\phi s$, the action point F reaches the point ($a_{max}$, 0) on the center line 5. In this case, the action point F is offset from the center line 5 in this preferred embodiment. Conversely, if the steering angles $\phi L$, $\phi R$ are controlled to set the angular speed $\omega$ at $\omega=0$, the action point F is located on a line 62 extending, through the instantaneous center G, at the target movement angle $\theta$. Then, the outputs (propulsive forces) of the port-side and starboard-side outboard motors 11, 12 are controlled to provide a combined vector TG having a desired magnitude and a desired direction.

In general, the instantaneous center G is located within the hull 2. Therefore, it is necessary to locate the action point F within a predetermined range $\Delta y$ having a width roughly equivalent to the width of the hull 2. When it is impossible to obtain the target angular speed $\omega_t$ even with the action point F being located within the predetermined range $\Delta y$, an alarm may be provided to notify the operator of this situation.

Similarly, when it is impossible to attain the target angular speed $\omega_t$ even with the action point F being located at the point ($a_{min}$, 0) on the center line 5 by increasing the steering angle $\phi R$, an alarm is preferably provided to notify the operator of this situation.

In the case shown in FIG. 7, the steering angles $\phi L$, $\phi R$ of the port-side and starboard-side outboard motors 11, 12 are calculated from the following expression so as to simplify of the control operation.

$$\phi L=\psi-\phi_S$$

$$\phi R=\psi+\phi_S$$

wherein $\psi$ is a steering angle correction value.

Therefore, the steering angles $\phi L$, $\phi R$ are determined by properly determining the steering angle correction value $\psi$ to attain the target angular speed $\omega_t$. Thus, the computation for the control operation is simplified. Here, the switching reference steering angle $\phi_S$ is a steering angle which is observed when the action point F is located at the point ($a_{max}$, 0) on the center line 5, and expressed by $\phi_S=\tan^{-1}(b/a_{max})$.

Referring to FIG. 4, a method for calculating the magnitudes $|TL|$, $|TR|$ of the propulsive forces to be generated from the port-side and starboard-side outboard motors 11, 12 will be described in more detail.

The magnitude $|TG_t|$ of the combined target propulsive force $TG_t$ input from the lateral movement operational section 10 is determined by the mass of the entire marine vessel 1 and the degree of acceleration to be generated. It is here in assumed that the magnitude $|TR_t|$ of the target propulsive force vector $TR_t$ for the starboard-side outboard motor 12 for providing the target combined propulsive force magnitude $|TG_t|$ is calculated from the following expression (1) by multiplying the magnitude $|TL_t|$ of the target propulsive force vector $TL_t$ for the port-side outboard motor 11 by a scalar k.

$$|TL_t|=k|TR_t| \tag{1}$$

It is further assumed that the target steering angles $\phi R_t$, $\phi L_t$ of the port-side and starboard-side outboard motors 11, 12 are determined so as to satisfy an expression $\phi_t=\phi R_t=-\phi L_t$ (wherein $\phi_t$ is a target steering angle basic value) in the lateral movement mode.

Where the target combined propulsive force vector $TG_t$ is provided by combining the target propulsive force vectors $TL_t$, $TR_t$ for the port-side and starboard-side outboard motors 11, 12, x-axis and y-axis components $TG_tx$, $TG_ty$ of the target combined propulsive force vector $TG_t$ satisfy the following expressions (2) and (3):

$$TG_tx=|TG_t|\cos\theta_t=|TR_t|\cos\phi_t+|TL_t|\cos\phi_t \tag{2}$$

$$TG_ty=|TG_t|\sin\theta_t=|TR_t|\sin\phi_t-|TL_t|\sin\phi_t \tag{3}$$

Then, the magnitude $|TR_t|$ of the target propulsive force vector $TR_t$ for the starboard-side outboard motor 12 is expressed by the following expression (4):

$$|TR_t| = \frac{|TG_t|(\cos\theta_t + \sin\theta_t)}{\{(1+k)\cos\phi_t + (1-k)\sin\phi_t\}} \tag{4}$$

On the other hand, the following expression (5) is obtained from the expressions (2) and (3).

$$\tan\theta_t = \frac{|T_R| - |T_L|}{|T_R| + |T_L|} \cdot \frac{\sin\phi_t}{\cos\phi_t} = \frac{|T_R| - |T_L|}{|T_R| + |T_L|} \cdot \tan\phi_t \tag{5}$$

The expression (1) is substituted in the expression (5) to provide the following expression (6).

$$\tan\theta_t = \frac{1-k}{1+k} \cdot \tan\phi_t \tag{6}$$

By solving this equation, the factor k is expressed by the following expression (7):

$$k = \frac{\tan\phi_t - \tan\theta_t}{\tan\phi_t + \tan\theta_t} \tag{7}$$

Therefore, the factor k is calculated from the expression (7) based on the target steering angle basic value $\phi_t$ ($=\phi R_t$) and the target movement angle $\theta_t$. The target propulsive force $|TR_t|$ for the starboard-side outboard motor 12 is calculated from the expression (4) based on the factor k, the target steering angle basic value $\phi_t$, the target movement angle $\theta_t$ and the target combined propulsive force $|TG_t|$. Further, the target propulsive force $|TL_t|$ for the port-side outboard motor 11 is calculated from the expression (1).

Therefore, the target propulsive forces $|TL_t|$, $|TR_t|$ for the port-side and starboard-side outboard motors 11, 12 are determined based on the input of the target steering angle basic value $\phi_t$ (which may be a value detected by the steering angle sensor 49), the target movement angle $\theta_t$ and the target combined propulsive force $|TG_t|$ through a computation process performed by the microcomputer.

However, when the target movement angle $\theta_t$ is $\theta_t=-\pi/4$ or $3\pi/4$ (rad), it is impossible to calculate the target propulsive force $|TR_t|$ from the expression (4) with the right side of the expression (4) being 0/0. Therefore, the target propulsive forces $|TL_t|$, $|TR_t|$ for different target movement angles $\theta_t$ from 0 to $2\pi$ in increments of $\pi/36$ are preliminarily calculated based on different target steering angle basic values $\phi_t$ and different target combined propulsive forces $|TG_t|$, and the results of the calculation are stored in the form of a map, which is used for the control of the propulsive forces.

If the action point F is offset from the center line 5 as shown in FIG. 7, the relationship $\phi L=-\phi R=-\phi$ is not satisfied. Even in this case, the aforementioned map is useful. This is because the target steering angles $\phi L_t$, $\phi R_t$ are determined from the expression $\phi L_t=\psi_t-\phi_S$ and $\phi R_t=\psi_t+\phi_S$. More specifically, the target steering angle basic value $\phi_t$ and the target movement angle $\theta_t$ are replaced with a target steering angle input value $\phi R_t-\psi_t$ (or $\phi_t\leftarrow\phi R-\psi_t$) and a target movement angle input value $\theta_t-\psi_t$, respectively, when the map is used.

Figure 8:
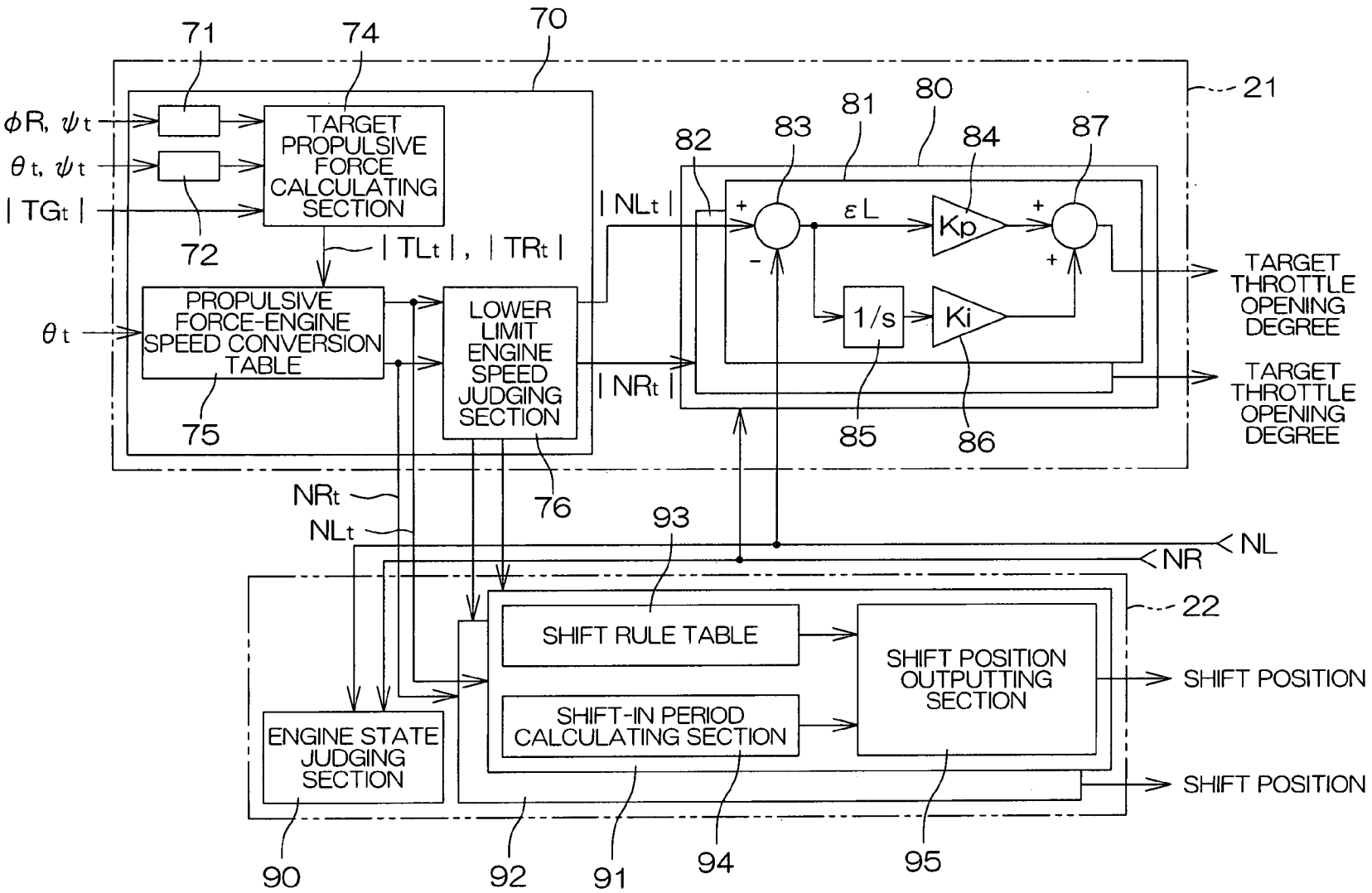
FIG. 8 is a block diagram illustrating the functions of a throttle controlling section and a shift controlling section, particularly, for explaining control operations to be performed by the throttle controlling section and the shift controlling section in the lateral movement mode.

FIG. 8 is a block diagram illustrating the function of the throttle controlling section 21 and the shift controlling section 22, particularly, for explaining control operations to be performed by the throttle controlling section 21 and the shift controlling section 22 in the lateral movement mode. The throttle controlling section 21 includes a target engine speed calculating module 70 (target propulsive force calculating section) which calculates target engine speeds $|NL_t|$, $|NR_t|$ of the engines 39 of the port-side and starboard-side outboard motors 11, 12, and a throttle opening degree calculating module 80 (propulsive force controlling section) which calculates the target throttle opening degrees of the engines 39 of the outboard motors 11, 12 based on the calculated target engine speeds $|NL_t|$, $|NR_t|$.

The target engine speed calculating module 70 includes a steering angle input value calculating section 71 which receives the steering angle $\phi R$ (or the target steering angle $\phi R_t$) of the starboard-side outboard motor 12 and the target steering angle correction value $\psi_t$ from the steering controlling section 23 and calculates the steering angle input value $\phi R-\psi_t$ (or $\phi R_t-\psi_t$) to be used in a map search, and a target movement angle input value calculating section 72 which calculates the target movement angle input value $\theta_t-\psi_t$ to be used in the map search based on the target movement angle $\theta_t$ and the target steering angle correction value $\psi_t$ from the lateral movement operational section 10. The target engine speed calculating module 70 further includes a target propulsive force calculating section 74 which calculates the target propulsive forces $|TL_t|$, $|TR_t|$ of the port-side and starboard-side outboard motor 11, 12, a propulsive force-to-engine speed conversion table 75 which determines the target engine speeds $NL_t$, $NR_t$ (with signs indicating the directions of the propulsive forces to be generated) of the port-side and starboard-side outboard motors 11, 12 for the target propulsive forces $|TL_t|$, $|TR_t|$, and a lower limit engine speed judging section 76 which calculates the absolute values $|NL_t|$, $|NR_t|$ of the target engine speeds and compares the absolute values $|NL_t|$, $|NR_t|$ with the lower limit engine speed (which is, for example, equal to the idle speed of the engines 39).

The target propulsive force calculating section 74 is defined by the aforementioned map which outputs the target propulsive forces $|TL_t|$, $|TR_t|$ of the port-side and starboard-side outboard motors 11, 12 based on the steering angle input value $\phi R-\psi_t$ (or $\phi R_t-\psi_t$), the target movement angle input value $\theta_t-\psi_t$ and the target combined propulsive force $|TG_t|$ applied from the lateral movement operational section 10.

The target propulsive forces $|TL_t|$, $|TR_t|$ are not suitable for the control of the engines 39 and, therefore, are converted into the target engine speeds $NL_t$, $NR_t$ according to the characteristics of the engines 39 with reference to the propulsive force-to-engine speed conversion table 75. The signs of the target engine speeds $NL_t$, $NR_t$ are determined according to the target movement angle $\theta_t$. More specifically, if the target movement angle $\theta_t$ is $0 \leqq \theta_t \leqq \pi$, a minus sign indicating the reverse drive direction is assigned to the target engine speed $NL_t$ of the port-side outboard motor 11, and a plus sign indicating the forward drive direction is assigned to the target engine speed $NR_t$ of the starboard-side outboard motor 12. On the other hand, if the target movement angle $\theta_t$ is $\pi<\theta_t<2\pi$ (or $-\pi<\theta_t<0$), a plus sign indicating the forward drive direction is assigned to the target engine speed $NL_t$ of the port-side outboard motor 11, and a minus sign indicating the reverse drive direction is assigned to the target engine speed $NR_t$ of the starboard-side outboard motor 12. The target engine speeds $NL_t$, $NR_t$ thus determined are input not only to the lower limit engine speed judging section 76 (rotational speed comparing section), but also to the shift controlling section 22.

The lower limit engine speed judging section 76 determines whether the absolute values $|NL_t|$, $|NR_t|$ of the target engine speeds are less than the lower limit engine speed NLL (which is equal to the idle speed), and applies judgment results to the shift controlling section 22. Further, the absolute values $|NL_t|$, $|NR_t|$ of the target engine speeds are applied to the throttle opening degree calculating module 80. However, if the target engine speed $|NL_t|$ of the port-side outboard motor 11 is less than the lower limit engine speed NLL, the lower limit engine speed judging section 76 substitutes the lower limit engine speed NLL for the target engine speed $|NL_t|$. Similarly, if the target engine speed $|NR_t|$ of the starboard-side outboard motor 12 is less than the lower limit engine speed NLL, the lower limit engine speed judging section 76 substitutes the lower limit engine speed NLL for the target engine speed $|NR_t|$.

The throttle opening degree calculating module 80 includes a port-side PI (proportional integration) control module 81 and a starboard-side PI control module 82, which have substantially the same construction. The port-side PI control module 81 receives the target engine speed $|NL_t|$ of the port-side outboard motor 11 input from the lower limit engine speed judging section 76, and a current engine speed NL ($\geqq 0$) input from the outboard motor ECU 13 of the port-side outboard motor 11. A deviation $\epsilon L=|NL_t|-NL$ of the current engine speed NL from the target engine speed $|NL_t|$ of the port-side outboard motor 11 is calculated by a deviation computing section 83. The deviation $\epsilon L$ is output from the deviation computing section 83 to a proportional gain multiplying section 84, and to an integrating section 85 in which the deviation $\epsilon L$ is subjected to a discrete integration process. The integration result provided by the integrating section 85 is applied to an integration gain multiplying section 86. The proportional gain multiplying section 84 outputs a value obtained by multiplying the deviation $\epsilon L$ by a proportional gain kp, and the integration gain multiplying section 86 outputs a value obtained by multiplying the integration value of the deviation $\epsilon L$ by an integration gain ki. These values are added by the adding section 87 to provide a target throttle opening degree of the engine 39 of the port-side outboard motor 11. The target throttle opening degree is applied to the outboard motor ECU 13 of the port-side outboard motor 11. The port-side PI control module 81 thus performs a so-called PI (proportional integration) control.

The starboard-side PI control module 82 has substantially the same construction as the port-side PI control module 81. That is, the starboard-side PI control module 82 processes a deviation $\epsilon R$ of a current engine speed NR ($\geqq 0$) from the target engine speed $|NR_t|$ of the starboard-side outboard motor 12 through the PI (proportional integration) control, and outputs a target throttle opening degree of the engine 39 of the starboard-side outboard motor 12. The target throttle opening degree is applied to the outboard motor ECU 14 of the starboard-side outboard motor 12.

The shift controlling section 22 includes a port-side shift control module 91 and a starboard-side shift control module 92, which have substantially the same construction. Each of the shift control modules 91, 92 generate a shift controlling signal for controlling the shift mechanism 43 (more specifically, the dog clutch 43*d*) of the outboard motor 11, 12 based on the target engine speed $NL_t$, $NR_t$ applied from the propulsive force-to-engine speed conversion table 75 to switch the shift position of the shift mechanism 43 to the forward drive position, the reverse drive position or the neutral position. Each of the shift control modules 91, 92 perform the intermittent shift control operation (intermittent coupling control operation) for periodically switching the shift position of the shift mechanism 43 alternately between the neutral position and the forward drive position or between the neutral position and the reverse drive position to intermittently couple the engine 39 to the propeller 40 when the target engine speed $NL_t$, $NR_t$ is less than the lower limit engine speed NLL.

The intermittent shift control operation will hereinafter be referred to as "PWM control" (pulse width modulation control). In a shift-in period $S_{in}$ of a PWM control period S, the rotation of the engine 39 is transmitted to the propeller shaft 42 with the shift position being set at the forward drive position or the reverse drive position. In a neutral period $S-S_{in}$ of the PWM control period S, the shift position is set at the neutral position.

The port-side shift control module 91 includes a shift rule table 93 which outputs the shift position (the forward drive position, the reverse drive position or the neutral position) of the shift mechanism 43 based on the sign of the target engine speed $NL_t$ of the port-side outboard motor 11 applied from the propulsive force-to-engine speed conversion table 75. The port-side shift control module 91 further includes a shift-in period calculating section 94 (coupling duration calculating section) which calculates the shift-in period $S_{in}$ based on the absolute value $|NL_t|$ of the target engine speed $NL_t$ applied from the propulsive force-to-engine speed conversion table 75. The port-side shift control module 91 further includes a shift position outputting section 95 (intermittent coupling controlling section) which generates a shift position signal indicating the shift position of the shift mechanism 43 of the port-side outboard motor 11 based on the outputs of the shift rule table 93 and the shift-in period calculating section 94.

The shift rule table 93 outputs a signal indicating the forward drive position when the target engine speed $NL_t$ has a plus sign, and outputs a signal indicating the reverse drive position when the target engine speed $NL_t$ has a minus sign. Where the absolute value of the target engine speed $NL_t$ is determined to be substantially zero (for example, not higher than about 100 rmp), the shift rule table 93 outputs a signal indicating the neutral position.

The shift-in period calculating section 94 sets the shift-in period $S_{in}$ at $S_{in}$=S if the lower limit engine speed judging section 76 determines that the target engine speed $NL_t$ is not less than the lower limit engine speed NLL. In this case, the PWM control is not performed, but the shift position of the shift mechanism 43 is maintained at the shift position output from the shift rule table 93. On the other hand, if the lower limit engine speed judging section 76 determines that the target engine speed $NL_t$ is less than the lower limit engine speed NLL, the shift-in period calculating section 94 sets the shift-in period $S_{in}$ at $S_{in}$=S·D wherein D=$NL_t$/NLL is a duty ratio for the PWM control.

The shift position outputting section 95 outputs the shift position signal in a cycle of the PWM period S. More specifically, the shift position outputting section 95 continuously generates the shift position signal according to the output of the shift rule table 93 over the shift-in period $S_{in}$ calculated by the shift-in period calculating section 94 in the PWM period S, and generates the shift position signal indicating the neutral position in the neutral period irrespective of the output of the shift rule table 93. If the shift-in period $S_{in}$ is $S_{in}$=S, the shift position signal according to the output of the shift rule table 93 is continuously output.

The starboard-side shift control module 92 has substantially the same construction as the port-side shift control module 91, and controls the shift position of the shift mechanism 43 of the starboard-side outboard motor 12 by performing the aforementioned operation based on the target engine speed $NR_t$ of the starboard-side outboard motor 12 and the judgment result on the absolute value of the target engine speed $NR_t$ provided by the lower limit engine speed judging section 76.

The engines 39 of the outboard motors 11, 12 are each intrinsically inoperative at an engine speed less than the lower limit engine speed NLL, such that an output less than the lower limit engine speed NLL is not provided. In this preferred embodiment, therefore, if the target engine speeds $NL_t$, $NR_t$ are each set to have an absolute value that is less than the lower limit engine speed NLL, the engines 39 are each operated at the lower limit engine speed NLL, and the rotation thereof is intermittently transmitted to the propeller 40 at the duty ratio D which depends upon the target engine speed $NL_t$, $NR_t$. Thus, the propulsive force can be provided for an engine speed that is less than the idle speed NLL.

The shift controlling section 22 further includes an engine state judging section 90 (motor state judging section) for judging whether the engines 39 of the port-side and starboard-side outboard motors 11, 12 are inactive in the lateral movement mode. The engine state judging section 90 acquires the engine speeds NL, NR of the engines 39 of the port-side and starboard-side outboard motors 11, 12 from the outboard motor ECUs 13, 14. Then, the engine state judging section 90 judges whether the engines 39 are active based on whether or not the engine speeds NL, NR are substantially zero. If at least one of the engines 39 of the outboard motors 11, 12 is inactive in the lateral movement mode, a signal indicating the inactive engine state is applied to the shift position outputting sections 95 of the shift control modules 91, 92. In response to this signal, each of the shift position outputting sections 95 controls the shift mechanism 43 of the outboard motor 11, 12 to switch the shift position of the shift mechanism 43 to the neutral position.

The engine state judging section 90 also functions as a restart controlling section for controlling the restart of the engines 39. That is, when the engine state judging section 90 determines that at least one of the engines 39 of the outboard motors 11, 12 is inactive in the lateral movement mode, the engine state judging section 90 provides a command to the outboard motor ECU 13, 14 of the corresponding outboard motor 11, 12 to restart the inactive engine 39. In response to the command, the outboard motor ECU 13, 14 actuates the starter motor 45 of the inactive engine 39.

The engine state judging section 90 monitors the engine speeds NL, NR to determine whether the inactive engine 39 is restarted. When the engines 39 of the respective outboard motors 11, 12 become active after the restart of the inactive engine 39, a signal indicating the engine active state is applied to the shift position outputting sections 95. In response to this signal, the shift position outputting sections 95 of the shift control modules 91, 92 are each returned to an ordinary state to control the shift mechanism 43 according to the outputs of the shift rule table 93 and the shift-in period calculating section 94.

Figure 9:
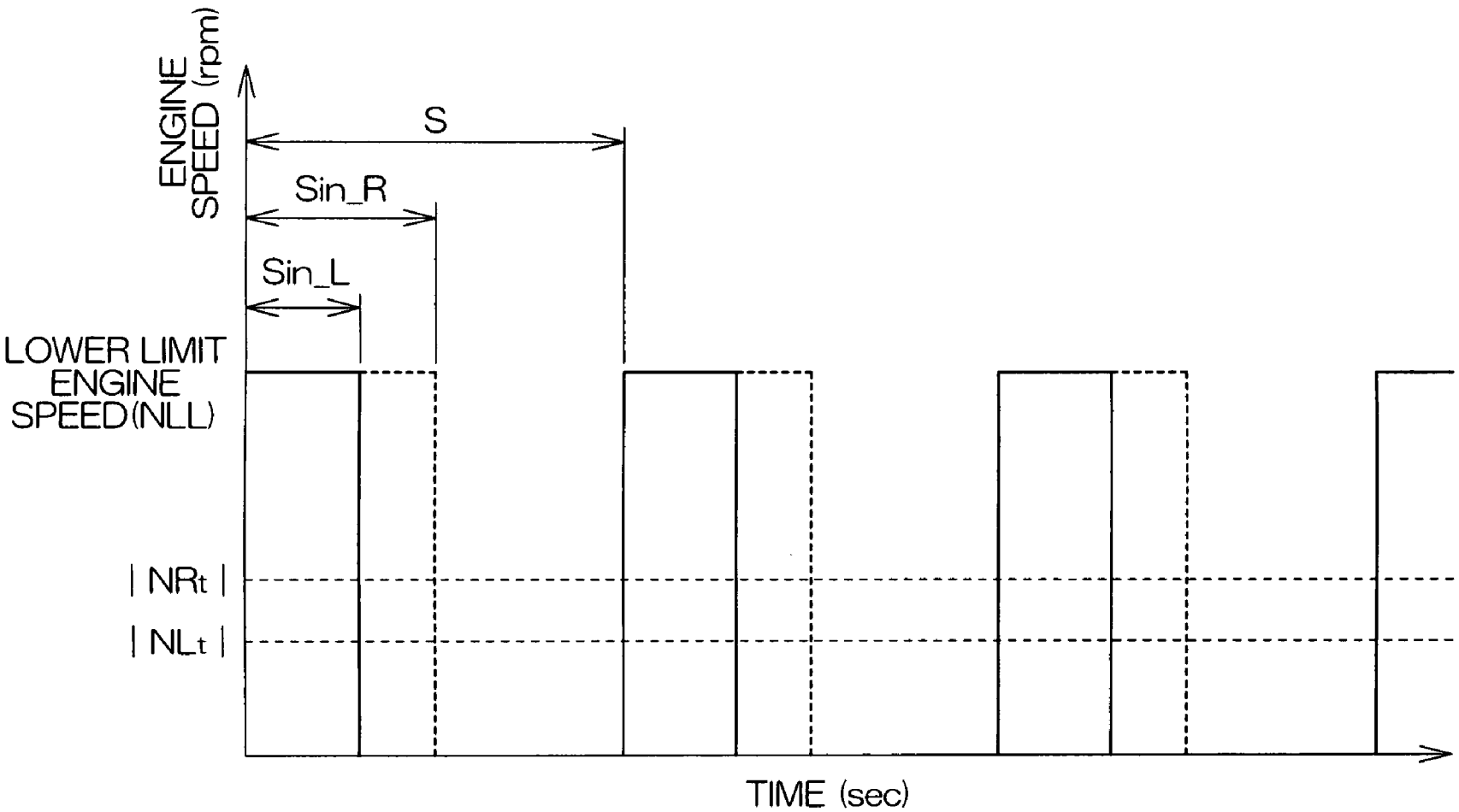
FIG. 9 is a timing chart of PWM operations to be performed by a port-side shift control module and a starboard-side shift control module.

FIG. 9 is a timing chart of the PWM operation to be performed by the port-side shift control module 91 and the starboard-side shift control module 92. In FIG. 9, solid lines indicate a change in the shift position of the shift mechanism 43 of the port-side outboard motor 11 to be controlled by the port-side shift control module 91, and broken lines indicate a change in the shift position of the shift mechanism 43 of the starboard-side outboard motor 12 to be controlled by the starboard-side shift control module 92.

Herein, it is assumed that the absolute values of the target engine speeds $NL_t$, $NR_t$ of the port-side and starboard-side outboard motors 11, 12 are less than the lower limit engine speed (idle speed) NLL. At this time, the shift-in period calculating sections 94 provided in the port-side shift control module 91 and the starboard-side shift control module 92 respectively calculate shift-in periods $S_{in}$_L and $S_{in}$_R. Therefore, the dog clutch 43*d* of the port-side outboard motor 11 is located at the forward drive position or the reverse drive position over the shift-in period $S_{in}$_L in the PWM period S, and located at the neutral drive position in a neutral period S-$S_{in}$_L. Similarly, the dog clutch 43*d* of the starboard-side outboard motor 12 is located at the forward drive position or the reverse drive position over the shift-in period $S_{in}$_R in the PWM period S, and located at the neutral drive position in a neutral period (S-$S_{in}$_R). In the shift-in periods $S_{in}$_L, $S_{in}$_R, the rotation of each of the engines 39 rotating at the lower limit engine speed NLL are transmitted to the corresponding propellers 40.

In this preferred embodiment, the PWM shift control operations performed by the shift position outputting sections 95 of the port-side and starboard-side shift control modules 91, 92 are synchronized with each other. That is, as shown in FIG. 9, the shift-in timings in the PWM shift control operations are synchronized in each PWM period. Thus, the on-board comfort is improved in the PWM control. Of course, the required propulsive forces can be generated from the respective outboard motors 11, 12 without synchronization of the PWM shift control operations. However, the lag of the shift timings of the port-side and starboard-side outboard motors 11, 12 results in poorer on-board comfort.

Figure 10:
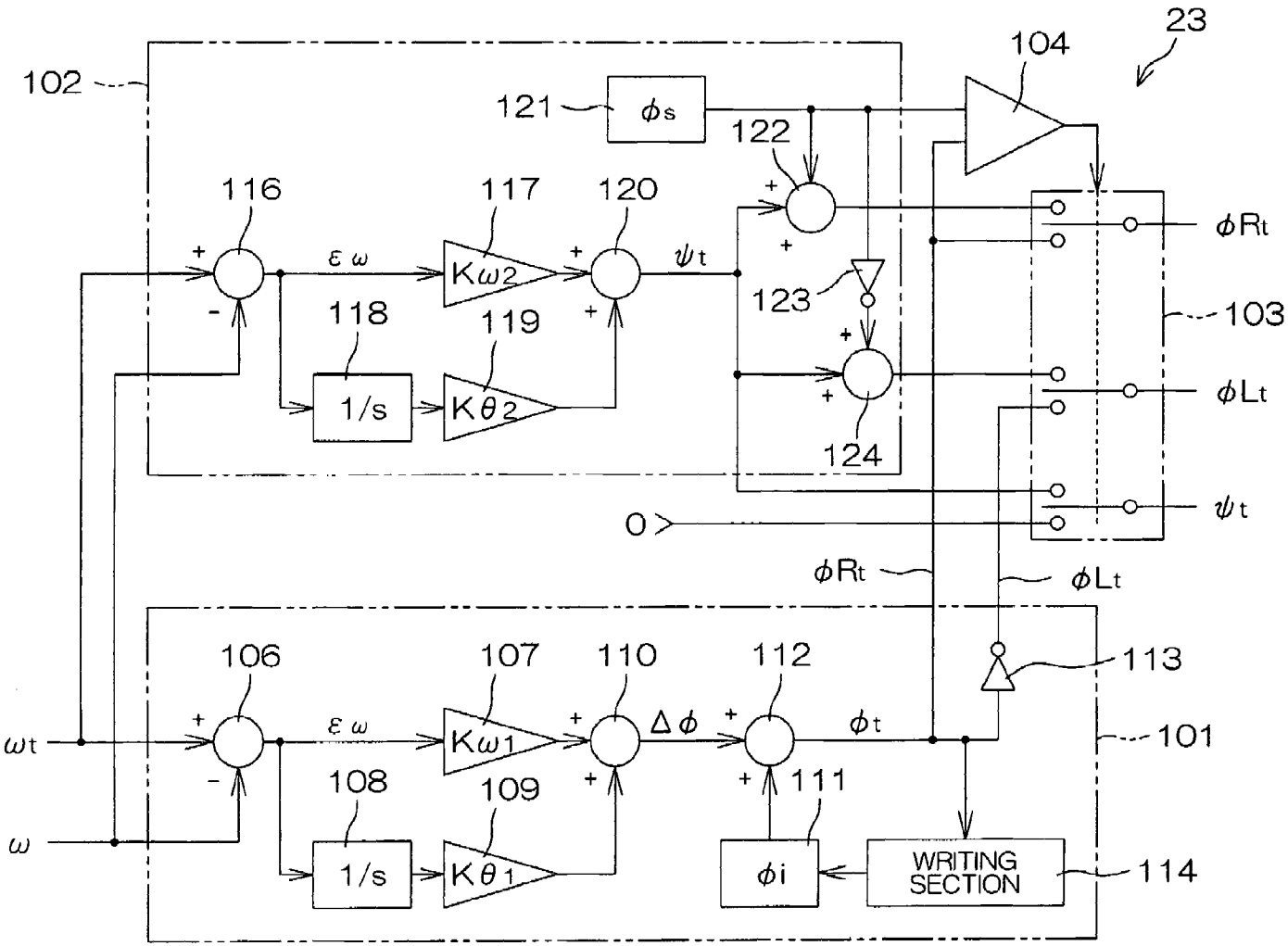
FIG. 10 is a block diagram illustrating the functions of a steering controlling section, particularly, for explaining a control operation to be performed by the steering controlling section in the lateral movement mode.

FIG. 10 is a block diagram illustrating the function of the steering controlling section 23, and particularly, for explaining a control operation to be performed by the steering controlling section 23 in the lateral movement mode. The steering controlling section 23 includes a first target steering angle computing section 101 (target steering angle calculating section) which computes the target steering angles $\phi R_t$, $\phi L_t$ to be set when the action point F is located on the center line 5, a second target steering angle computing section 102 (target steering angle calculating section) which computes the target steering angle $\phi R_t$, $\phi L_t$ to be set when the action point F is located outside of the center line 5, a selector 103 which selects outputs of either of the first target steering angle computing section 101 and the second target steering angle computing section 102, and a comparing section 104 which controls switching of the selector 103.

The comparing section 104 compares the target steering angle $\phi R_t$ of the starboard-side outboard motor 12 computed by the first target steering angle computing section 101 with the switching reference steering angle $\phi_S$ (=tan $^{-1}$(b/$a_{max}$). That is, if the target steering angle $\phi R_t$ of the starboard-side outboard motor 12 computed by the first target steering angle computing section 101 is not less than the switching reference steering angle $\phi_S$, the comparing section 104 controls the selector 103 to select the outputs of the first target steering angle computing section 101. On the other hand, if the target steering angle $\phi R_t$ of the starboard-side outboard motor 12 computed by the first target steering angle computing section 101 is less than the switching reference steering angle $\phi_S$, the comparing section 104 controls the selector 103 to select the outputs of the second target steering angle computing section 102.

The first target steering angle computing section 101 is defined by a PI (proportional integration) control module based on the input of the angular speed $\omega$ detected by the yaw rate sensor 9 and the target angular speed $\omega_t$ applied from the lateral movement operational section 10. That is, the first target steering angle computing section 101 is operative so as to set the angular speed $\omega$ so as to be substantially equal to the target angular speed $\omega_t$ through PI control. More specifically, the first target steering angle computing section 101 includes a deviation computing section 106 which computes a deviation $\epsilon_\omega$ of the angular speed $\omega$ from the target angular speed $\omega_t$, a proportional gain multiplying section 107 which multiplies the output $\epsilon_\omega$ of the deviation computing section 106 by a proportional gain $k_{\omega 1}$, an integrating section 108 which integrates the deviation $\epsilon_\omega$ output from the deviation computing section 106, an integration gain multiplying section 109 which multiplies the output of the integrating section 108 by an integration gain $k_{\Theta 1}$, and a first adding section 110 which generates a steering angle deviation $\Delta\phi$ by adding the output of the proportional gain multiplying section 107 and the output of the integration gain multiplying section 109. These components define a steering angle deviation computing section.

Further, the first target steering angle computing section 101 includes a memory 111 (basic target steering angle storing section) which stores an initial target steering angle $\phi i$ as a basic target steering angle, and a second adding section 112 (adding section) which determines the target steering angle basic value $\phi_t$ (=$\phi i+\Delta\phi$) by adding the steering angle deviation $\Delta\phi$ generated by the first adding section 110 to the initial target steering angle $\phi i$ stored in the memory 111. The target steering angle basic value $\phi_t$ is used as the target steering angle $\phi R_t$ of the starboard-side outboard motor 12. Further, the sign of the target steering angle basic value $\phi_t$ is reversed by a reversing section 113 to provide a value $-\phi_t$ which is used as the target steering angle $\phi L_t$ of the port-side outboard motor 11.

The memory 111 is a nonvolatile rewritable memory, such as a flash memory or an EEPROM (electrically erasable programmable read only memory). The initial target steering angle $\phi i$ is written in the memory 111, for example, by a special inputting device prior to delivery of the marine vessel 1 from a dealer to a user. The initial target steering angle $\phi i$ is set at $\phi i$=tan $^{-1}$(b/$a_i$) based on a design instantaneous center Gi($a_i$,0) which is determined by the type of the hull 2 and the outboard motors 11, 12. The instantaneous center Gi($a_i$,0) may be experimentally determined by test cruising.

Parameters $a_i$ and b for the initial target steering angle $\phi i$ may be stored as initial target steering angle information in the memory 111. In this case, the initial target steering angle $\phi i$ is calculated from an expression $\phi i$=tan $^{-1}$(b/$a_i$).

In this preferred embodiment, a learning function is provided for learning the fluctuation of the instantaneous center G dependant upon a change in the load on the marine vessel 1 and other factors. That is, a writing section 114 is provided for updating the initial target steering angle $\phi i$ in the memory 111. The writing section 114 writes the target steering angle basic value $\phi_t$ generated by the second adding section 112 as a new initial target steering angle $\phi i$ in the memory 111 when the running control is terminated by stopping the driving of the outboard motors 11, 12 or when the control mode is switched from the lateral movement mode to the ordinary running mode.

The second target steering angle computing section 102 is also defined by a PI (proportional integration) control module based on the input of the angular speed $\omega$ detected by the yaw rate sensor 9 and the target angular speed $\omega_t$ applied from the lateral movement operational section 10. That is, the second target steering angle computing section 102 sets the angular speed $\omega$ so as to be substantially equal to the target angular speed $\omega_t$ through PI control. More specifically, the second target steering angle computing section 102 includes a deviation computing section 116 which computes a deviation $\epsilon_\omega$ of the angular speed $\omega$ from the target angular speed $\omega_t$, a proportional gain multiplying section 117 which multiplies the output $\epsilon_\omega$ of the deviation computing section 116 by a proportional gain $k_{\omega 2}$, an integrating section 118 which integrates the deviation $\epsilon_\omega$ output from the deviation computing section 116, an integration gain multiplying section 119 which multiplies the output of the integrating section 118 by an integration gain $k_{\Theta 2}$, and a first adding section 120 which generates a target steering angle correction value $\psi_t$ by adding the output of the proportional gain multiplying section 117 and the output of the integration gain multiplying section 119. The second target steering angle computing section 102 further includes a memory 121 which stores the switching reference steering angle $\phi_S$, a second adding section 122 which determines the target steering angle $\phi R_t$ (=$\phi_S+\psi_t$) of the starboard-side outboard motor 12 by adding the switching reference steering angle $\phi_S$ stored in the memory 121 to the target steering angle correction value $\psi_t$ generated by the first adding section 120, a reversing section 123 which reverses the sign of the switching reference steering angle $\phi_S$ to provide an reversed value $-\phi_S$, and a third adding section 124 which provides the target steering angle $\phi L_t$ (=$-\phi_S+\psi_t$) of the port-side outboard motor 11 by adding the target steering angle correction value $\psi_t$ to the value $-\phi_S$ provided by the reversing section 123. The switching reference steering angle $\phi_S$ is also applied to the comparing section 104 from the memory 121.

Further, the selector 103 selectively outputs the target steering angle correction value $\psi_t$ provided by the first adding section 120 or zero.

With this arrangement, if it is possible to attain the target angular speed $\omega_t$ by moving the action point F in the predetermined range $\Delta x$ (x=$a_{min}$ to $a_{max}$, see FIG. 7) on the center line 5, the selector 103 selects the target steering angles $\phi L_t$, $\phi R_t$ provided by the first target steering angle computing section 101, and applies the target steering angles $\phi L_t$, $\phi R_t$ to the outboard motor ECUs 13, 14. At this time, the target steering angles $\phi L_t$, $\phi R_t$ of the port-side and starboard-side outboard motors 11, 12 satisfy the relationship $\phi L_t=-\phi R_t$. Further, the selector 103 outputs $\psi_t=0$ as the target steering angle correction value $\psi_t$ to be used for the computation in the throttle controlling section 21.

On the other hand, if it is not possible to attain the target angular speed $\psi_t$ by moving the action point F in the predetermined range $\Delta x$ on the center line 5, the target steering angle $\phi R_t$ becomes less than the switching reference steering angle $\phi_S$ ($\phi R_t<\phi_S$) when the action point F reaches the endpoint ($a_{max}$, 0) of the range $\Delta x$. Therefore, the selector 103 selects the output of the second target steering angle computing section 102. Thus, the target steering angles $\phi L_t$, $\phi R_t$ based on the switching reference steering angle $\phi_S$ are set for the port-side and starboard-side outboard motors 11, 12, such that the action point F is located outside the center line 5. Further, the selector 103 outputs the value provided by the first adding section 120 as the target steering angle correction value $\psi_t$ to be used for the computation in the throttle controlling section 21.

Figure 11:
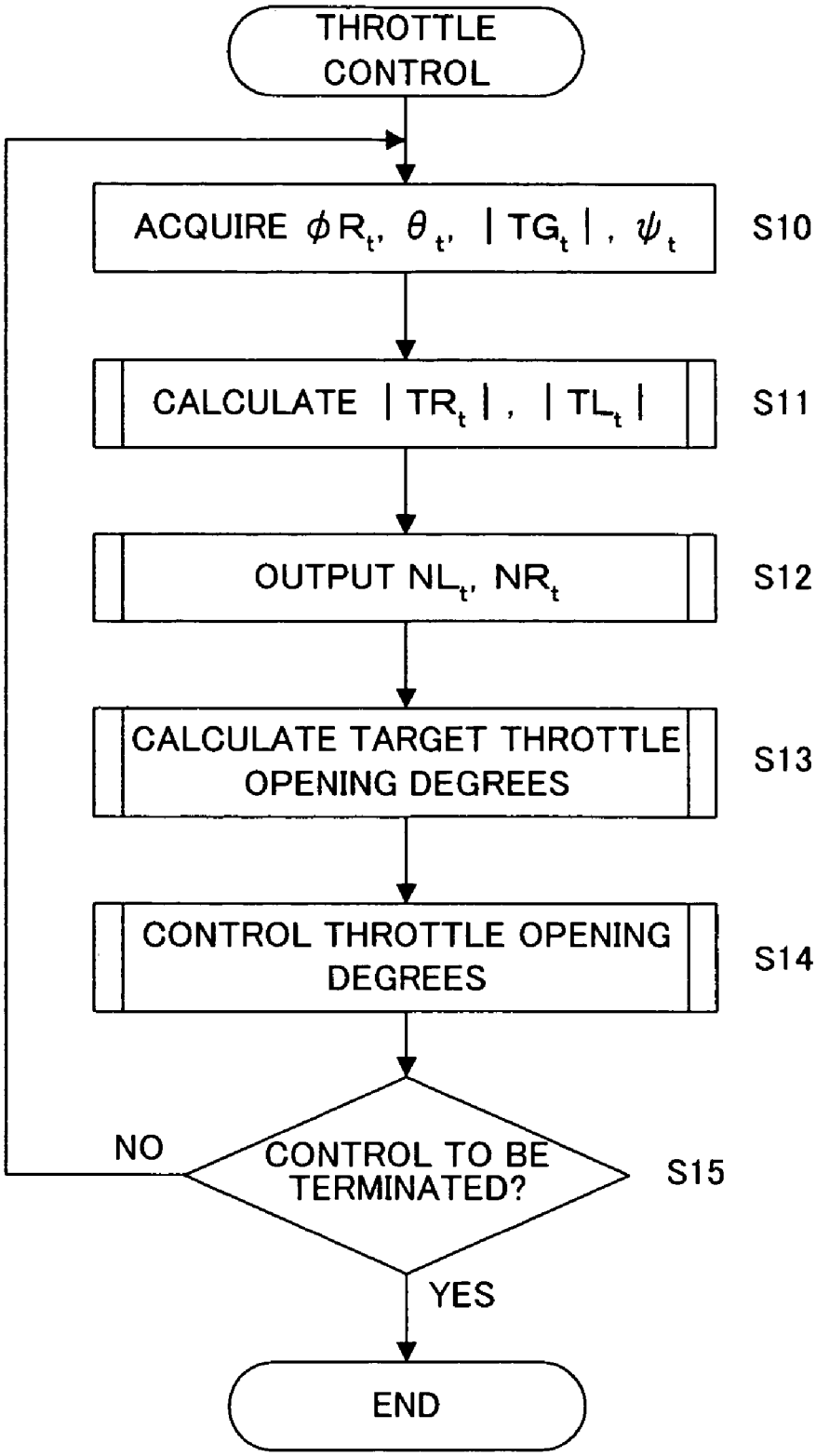
FIG. 11 is a flow chart for explaining a throttle controlling operation.

FIG. 11 is a flow chart for explaining a throttle controlling operation to be performed by the throttle controlling section 21. The target engine speed calculating module 70 acquires the starboard-side target steering angle $\phi R_t$ (or the actually detected steering angle $\phi R$) and the target steering angle correction value $\psi_t$ from the steering controlling section 23, and acquires the target movement angle $\theta_t$ and the target combined propulsive force $|TG_t|$ from the lateral movement operational section 10 (Step S10).

The target propulsive forces $|TL_t|$, $|TR_t|$ of the port-side and starboard-side outboard motors 11, 12 are calculated based on the starboard-side target steering angle $\phi R_t$, the target steering angle correction value $\psi_t$, the target movement angle $\theta_t$ and the target combined propulsive force $|TG_t|$ primarily by the operation of the target propulsive force calculating section 74 (Step S11). Further, the target engine speeds $NL_t$, $NR_t$ are determined according to the target propulsive forces $|TL_t|$, $|TR_t|$ and the target movement angle $\theta_t$ by the propulsive force-to-engine speed conversion table 75 (if the absolute values of the target engine speeds $NL_t$, $NR_t$ are less than the lower limit engine speed NLL, the target engine speeds $NL_t$, $NR_t$ are each set at the lower limit engine speed NLL) (Step S12). Throttle opening degree commands are generated based on the target engine speeds $NL_t$, $NR_t$ primarily by the operation of the throttle opening degree calculating module 80, and applied to the outboard motor ECUs 13, 14 (Step S13). According to the applied throttle opening degree commands, the outboard motor ECUs 13, 14 control the respective throttle actuators 52 (Step S14). In this manner, the throttle opening degrees of the engines 39 of the respective outboard motors 11, 12 are controlled, whereby the engine speeds of the engines 39 are controlled. Thus, the port-side and starboard-side outboard motors 11, 12 generate the target propulsive forces $|TL_t|$, $|TR_t|$, respectively.

The throttle controlling section 21 determines whether the control operation in the lateral movement mode is to be continued (Step S15). This judgment is based on whether the operation of the lateral movement operational section 10 is continued, i.e., whether a significant input from the lateral movement operational section 10 is detected. If a significant input from the steering operational section 7 or the throttle operational section 8 is detected, the control operation from Step S10 to Step S14 is terminated to return the control mode to the ordinary running mode from the lateral movement mode. If the control operation in the lateral movement mode is continued, the process beginning from Step S10 is repeated.

Figure 12:
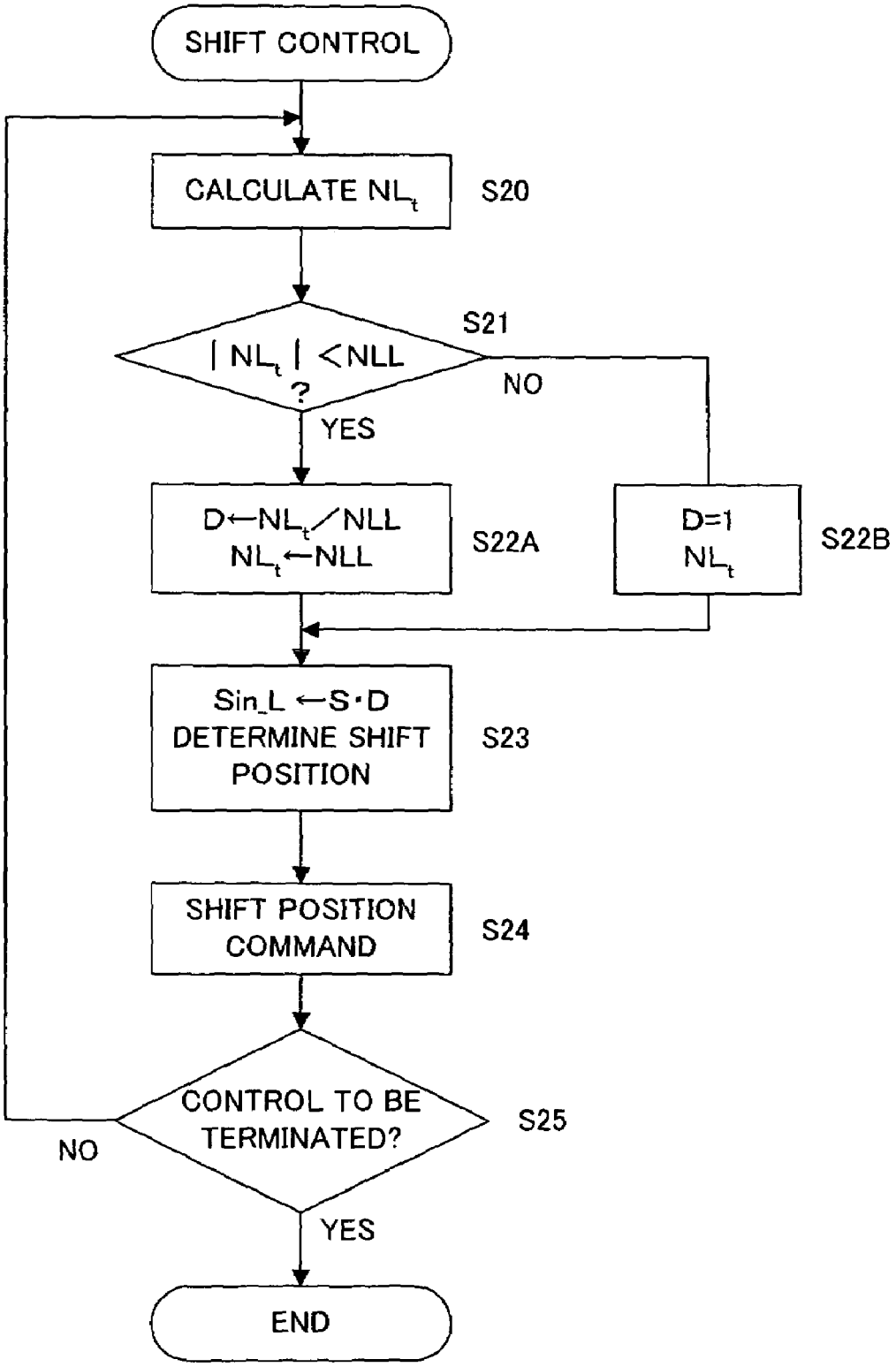
FIG. 12 is a flow chart for explaining an operation for controlling a shift mechanism of a port-side outboard motor.

FIG. 12 is a flow chart for explaining a control operation for controlling the shift mechanism 43 of the port-side outboard motor 11. When the target engine speed $NL_t$ is provided by the propulsion force-to-engine speed conversion table 75 (Step S20), the lower limit engine speed judging section 76 compares the absolute value $|NL_t|$ of the target engine speed $NL_t$ with the lower limit engine speed NLL (Step S21). If the target engine speed $NL_t$ is less than the lower limit engine speed NLL, the shift-in period calculating section 94 of the shift controlling section 22 sets the duty ratio D at $D=NL_t/NLL$, and the lower limit engine speed judging section 76 inputs the target engine speed $NL_t$ having an absolute value replaced with the value of the lower limit engine speed NLL to the throttle opening degree calculating module 80 (the port-side PI control module 81) (Step S22A).

The shift-in period calculating section 94 calculates the shift-in period $S_{in}=S\cdot D$ (Step S23). Further, the shift position is determined according to the target engine speed $NL_t$ by the shift rule table 93 (Step S23). Based on the shift-in period $S_{in}$ and the shift position, a shift position command is output from the shift position outputting section 95 (Step S24). The outboard motor ECU 13 controls the shift actuator 52 based on the shift position command.

If the target engine speed $NL_t$ is not less than the lower limit engine speed NLL (Step S21), the shift-in period calculating section 94 sets the duty ratio D at D=1, and the lower limit engine speed judging section 76 inputs the target engine speed $NL_t$ as is to the throttle opening degree calculating module 80 (the port-side PI control module 81) (Step S22B). Thereafter, an operation from Step S23 is performed.

Judgment in Step S25 is performed in the same manner as in Step S15 of FIG. 11 by the throttle controlling section 21.

A control operation for the shift mechanism 43 of the starboard-side outboard motor 12 is performed in substantially the same manner.

Figure 13:
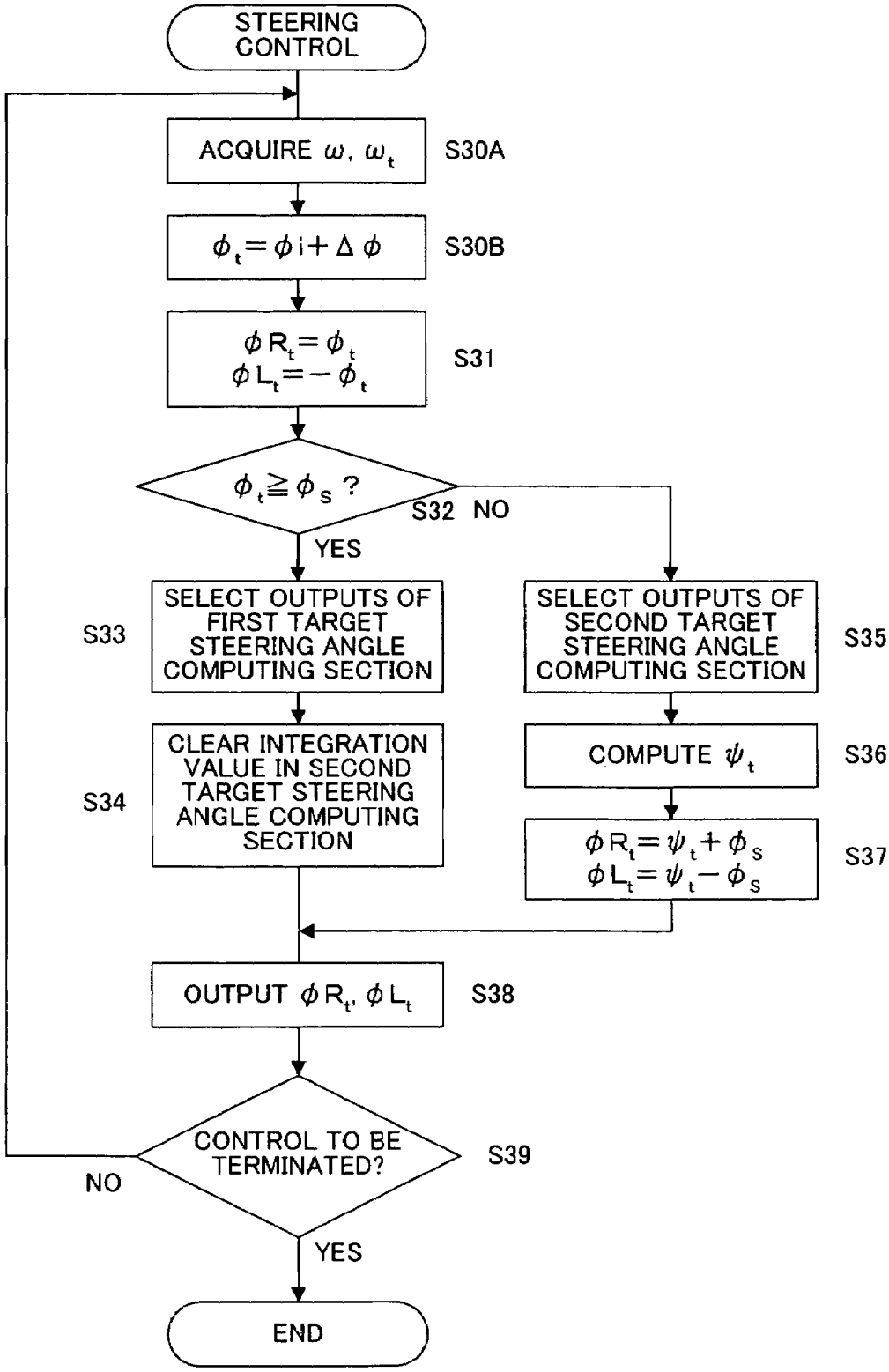
FIG. 13 is a flow chart for explaining the control operation to be performed by the steering controlling section in the lateral movement mode.

FIG. 13 is a flow chart for explaining a control operation to be performed by the steering controlling section 23 in the lateral movement mode. The steering controlling section 23 acquires the angular speed $\omega$ detected by the yaw rate sensor 9 and the target angular speed $\omega_t$ input from the lateral movement operational section 10 (Step S30A). The first target steering angle computing section 101 determines the target steering angle basic value $\phi_t=\phi i+\Delta\phi$ through the PI control (Step S30B). Then, the target steering angles $\phi L_t=-\phi_t$, $\phi R_t=\phi_t$ of the port-side and starboard-side outboard motors 11, 12 are determined and input to the selector 103 (Step S31).

On the other hand, the comparing section 104 compares the target steering angle basic value $\phi_t$ with the switching reference steering angle $\phi_S$ ($=\tan^{-1}(b/a_{max})$) (Step S32). If $\phi_t\geqq\phi_S$, the selector 103 is controlled to select the output of the first target steering angle computing section 101 (Step S33). Then, the steering controlling section 23 resets the integration value of the integrating section 118 of the second target steering angle computing section 102 to zero (Step S34). If $\phi_t<\phi_S$, the selector 103 is controlled to select the output of the second target steering angle computing section 102 (Step S35). The second target steering angle computing section 102 calculates the target steering angle correction value $\psi_t$ through the PI control (Step S36). Based on the target steering angle correction value $\psi_t$, the target steering angles $\phi L_t=\psi_t-\phi_S$, $\phi R_t=\psi_t+\phi_S$ of the port-side and starboard-side outboard motors 11, 12 are calculated (Step S37).

The target steering angles $\phi L_t$, $\phi R_t$ of the port-side and starboard-side outboard motors 11, 12 selected by the selector 103 are output to the outboard motor ECUs 13, 14 (Step S38). Therefore, the outboard motor ECUs 13, 14 respectively control the steering actuators 53 of the port-side and starboard-side outboard motors 11, 12 based on the applied target steering angles $\phi L_t$, $\phi R_t$. Thereafter, the steering controlling section 23 determines whether the control operation in the lateral movement mode is to be terminated (Step S39). The judgment is performed in the same manner as in Step S15 of FIG. 11 by the throttle controlling section 21. If the operation in the lateral movement mode is continued, the process beginning from Step S30A is repeated.

Figure 14:
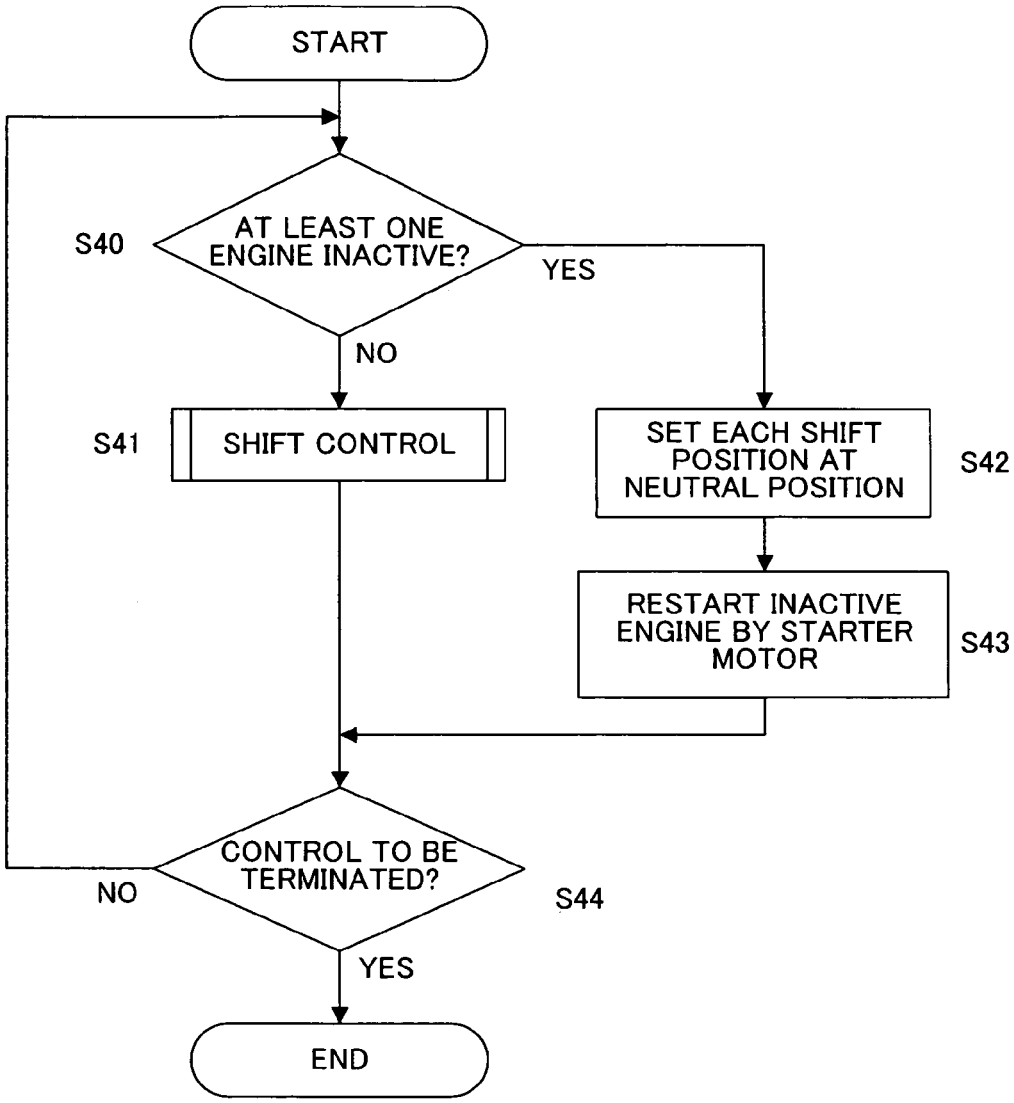
FIG. 14 is a flow chart for explaining an outboard motor stop detecting operation.

FIG. 14 is a flow chart for explaining an engine stop checking process to be performed in the lateral movement mode by the engine state judging section 90 of the shift controlling section 22 for checking the engine stop of the outboard motors 11, 12. The engine state judging section 90 monitors the engine speeds NL, NR applied from the outboard motor ECUs 13, 14 to determine whether or not the engines 39 of the outboard motors 11, 12 are inactive (Step S40). If the engines 39 of the outboard motors 11, 12 are both active, the shift position outputting sections 95 continuously control the respective shift mechanisms 43 (Step S41).

On the other hand, if the inactive state of at least one of the engines 39 of the outboard motors 11, 12 is detected, a command for setting the shift position of each of the shift mechanisms 43 of the outboard motors 11, 12 at the neutral position is applied to the shift position outputting sections 95 (Step S42). Thus, neither of the outboard motors 11, 12 generate the propulsive forces. Then, a restart command for restarting the inactive engine 39 is applied to the corresponding one of the outboard motor ECUs 13, 14 of the outboard motors 11, 12 from the engine state judging section 90 (Step S43). Thus, the inactive engine 39 is restarted by the starter motor 45 of the corresponding outboard motor 11, 12.

Thereafter, the engine state judging section 90 determines whether the control operation is to be terminated (Step S44). The judgment is performed in the same manner as in Step S15 of FIG. 11 by the throttle controlling section 21. If the control operation in the lateral movement mode is continued, the process beginning from Step S40 is repeated.

Figure 15:
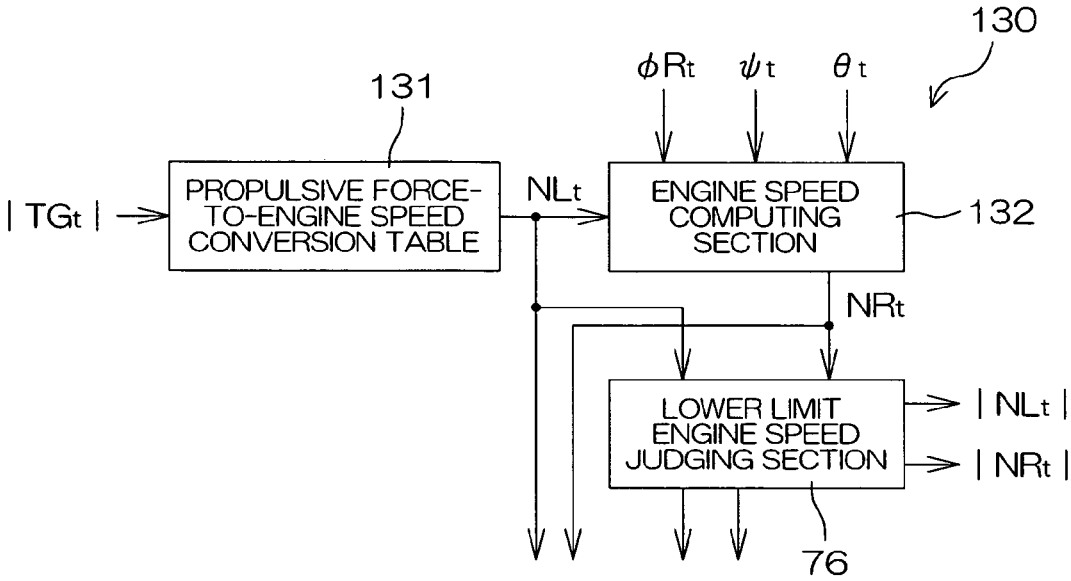
FIG. 15 is a block diagram illustrating a second preferred embodiment of the present invention, particularly illustrating an engine speed calculating module to be employed in place of an engine speed calculating module shown in FIG. 8.

FIG. 15 is a block diagram illustrating a second preferred embodiment of the present invention, and particularly illustrating the construction of an engine speed calculating module 130 to be provided instead of the target engine speed calculating module 70 shown in FIG. 8. In FIG. 15, functional components corresponding to those shown in FIG. 8 are denoted by the same reference characters as in FIG. 8. Further, reference will be made again to FIGS. 1 to 14.

In this preferred embodiment, the target engine speed $NL_t$ of the port-side outboard motor 11 is determined according to the target combined propulsive force $|TG_t|$ applied from the lateral movement operational section 10 by a propulsive force-to-engine speed conversion table 131 (first rotational speed setting section The target engine speed $NL_t$ is applied to an engine speed computing section 132 (second rotational speed setting section Further, the target steering angle $\phi R_t$ (or the detected steering angle $\phi R$) of the starboard-side outboard motor 12, the target steering angle correction value $\psi_t$ and the target movement angle $\theta_t$ are applied to an engine speed computing section 132. Based on the target engine speed $NL_t$, the target steering angle $\phi R_t$, the target steering angle correction value $\psi_t$ and the target movement angle $\theta_t$, the engine speed computing section 132 determines the target engine speed $NR_t$ for the engine 39 of the starboard-side outboard motor 12 so as to provide the combined propulsive force for moving the hull 2 at the target movement angle $\theta_t$.

The target engine speed $NL_t$ is not necessarily equal to an engine speed required to generate a propulsive force from the outboard motor 11 for providing the target combined propulsive force $|TG_t|$, but is preferably less than that engine speed. In the lateral maneuvering operation, the directions of the propulsive forces generated by the outboard motors 11, 12 are significantly different from the movement direction of the hull 2 and, therefore, the engines 39 of the outboard motors 11, 12 are operated at high engine speeds in spite of the fact that the combined propulsive force $|TG|$ is relatively small. Therefore, a loud engine sound arouses unnatural or uncomfortable feeling in the operator and the crew during the lateral maneuvering operation.

In this preferred embodiment, the operation amount of the lateral movement operational section 10 is associated with the engine speed of the port-side outboard motor 11. Therefore, the engines 39 are operated at engine speeds that are expected in association with the operation amount of the lateral movement operational section 10 by the operator. As a result, the uncomfortable feeling attributable to the loud engine sound is mitigated. Since the engine speeds can be provided according to the operation amount of the lateral movement operational section 10, the operator's unnatural feeling is eliminated.

While two preferred embodiments of the present invention have thus been described, the present invention may be embodied in many other ways. In the preferred embodiments described above, it is assumed that the instantaneous center G of the hull 2 varies. However, where the instantaneous center G is considered to be virtually fixed, the construction of the marine vessel running controlling apparatus and the control method is simplified. More specifically, target steering angle basic values $\phi_t$ may be preliminarily defined for different target angular speeds $\omega_t$ and stored in a memory. In this case, the target steering angles $\phi L_t$, $\phi R_t$ of the port-side and starboard-side outboard motors 11, 12 are determined by reading a target steering angle basic value $\phi_t$ from the memory in the lateral movement mode. If it is possible to fix the target angular speed $\omega_t$ at zero, the target steering angle basic value $\phi_t$ in the lateral movement mode may be fixed at a value which is determined by a geometrical relationship between the instantaneous center G and the propulsive force generating positions of the outboard motors 11, 12 (to coincide the action point F with the instantaneous center G). In this case, the construction of the marine vessel running controlling apparatus and the control method is further simplified.

The propulsive forces are controlled by controlling the outputs of the engines 39 in the preferred embodiments described above. However, the propulsive forces may be controlled by using propulsion systems including a variable pitch propeller whose propeller angle (pitch) is controllable. In this case, target pitches of the variable pitch propellers are calculated according to target propulsive forces, and the pitches of the variable pitch propellers are set at the target pitches thus calculated.

Although the preferred embodiments described above are directed to the marine vessel 1 including two outboard motors 11, 12, the marine vessel 1 may further include a third outboard motor provided on the center line 5 of the hull 2.

While the present invention has been described in detail with reference to the preferred embodiments thereof, it should be understood that the foregoing disclosure is merely illustrative of the technical principles of the present invention but not limitative of the same. The spirit and scope of the present invention are to be limited only by the appended claims.

This application corresponds to Japanese Patent Application Nos. 2003-361459 and 2003-361460 filed with the Japanese Patent Office on Oct. 22, 2003, the disclosure of which is incorporated herein by reference.

What is claimed is:

1. A marine vessel running controlling apparatus for controlling running of a marine vessel that includes a pair of propulsion systems which respectively generate propulsive forces on a rear port side and a rear starboard side of a hull, and a pair of steering mechanisms which respectively change steering angles defined by directions of the propulsive forces generated by the respective propulsion systems with respect to the hull, the marine vessel running controlling apparatus comprising:

a target combined propulsive force acquiring section which acquires a target combined propulsive force to be applied to the hull by the pair of propulsion systems;

a target movement angle acquiring section which acquires a target movement angle defined by a target movement direction of the hull with respect to a stem direction of the hull;

a steering controlling section which controls the steering angles of the respective steering mechanisms such that a turning angular speed of the hull is substantially equal to a predetermined target angular speed;

a target propulsive force calculating section which calculates target propulsive forces to be generated from the respective propulsion systems based on the target combined propulsive force acquired by the target combined propulsive force acquiring section, the target movement angle acquired by the target movement angle acquiring section and the steering angles of the respective steering mechanisms; and a propulsive force controlling section which controls the respective propulsion systems so as to attain the target propulsive forces calculated by the target propulsive force calculating section.

2. A marine vessel running controlling apparatus as set forth in claim 1, further comprising:

an angular speed detecting section which detects the turning angular speed of the hull; wherein the steering controlling section includes a target steering angle calculating section which calculates target steering angles of the respective steering mechanisms such that the turning angular speed detected by the angular speed detecting section is substantially equal to the target angular speed.

3. A marine vessel running controlling apparatus as set forth in claim 2, wherein the target steering angle calculating section calculates the target steering angles of the respective steering mechanisms such that action lines along which the propulsive forces are generated by the respective propulsion systems intersect each other at a center line of the hull extending through a stem and a stern of the hull.

4. A marine vessel running controlling apparatus as set forth in claim 3, wherein the target steering angle calculating section calculates one of the target steering angles of the steering mechanisms by adding a constant $\phi_c$ to a steering angle correction value $\psi$ ($\psi>0$) and calculates the other target steering angle by subtracting the constant $\phi_c$ from the steering angle correction value $\psi$ when an action point defined by an intersection of the action lines is located outside of the center line of the hull.

5. A marine vessel running controlling apparatus as set forth in claim 2, wherein the target steering angle calculating section includes:

a basic target steering angle storing section which stores a basic target steering angle;

a steering angle deviation computing section which computes a steering angle deviation based on a deviation of the angular speed detected by the angular speed detecting section from the target angular speed; and an adding section which adds the steering angle deviation computed by the steering angle deviation computing section to the basic target steering angle stored in the basic target steering angle storing section.

6. A marine vessel running controlling apparatus as set forth in claim 5, further comprising a writing section which writes an output of the adding section as a new basic target steering angle in the basic target steering angle storing section at predetermined times.

7. A marine vessel running controlling apparatus as set forth in claim 2, further comprising:

a target angular speed acquiring section which acquires the target angular speed of the hull; wherein the target steering angle calculating section calculates the target steering angles of the respective steering mechanisms such that the turning angular speed detected by the angular speed detecting section is substantially equal to the target angular speed acquired by the target angular speed acquiring section.

8. A marine vessel running controlling apparatus as set forth in claim 1, wherein the propulsion systems each include a motor as a drive source; and the target propulsive force calculating section includes:

a first rotational speed setting section which determines a rotational speed of the motor of one of the propulsion systems according to the target combined propulsive force acquired by the target combined propulsive force acquiring section; and a second rotational speed setting section which determines a rotational speed of the motor of the other propulsion system according to the rotational speed determined by the first rotational speed setting section, the target movement angle acquired by the target movement angle acquiring section and at least one of the steering angles of the steering mechanisms.

9. A marine vessel running controlling apparatus as set forth in claim 1, wherein the target angular speed is zero.

10. A marine vessel running controlling apparatus as set forth in claim 1, further comprising:

a pair of trim mechanisms which respectively change trim angles defined by the directions of the propulsive forces generated by the respective propulsion systems with respect to a horizontal plane; and a trim angle controlling section which controls the trim mechanisms such that the trim angles of the respective propulsion systems are substantially equal to each other.

11. A marine vessel maneuvering supporting system for supporting maneuvering of a marine vessel that includes a pair of propulsion systems which respectively generate propulsive forces on a rear port side and a rear starboard side of a hull, and a pair of steering mechanisms which respectively change steering angles defined by directions of the propulsive forces generated by the respective propulsion systems with respect to the hull, the marine vessel maneuvering supporting system comprising:

a target propulsive force inputting section for inputting a target combined propulsive force to be applied to the hull by the pair of propulsion systems;

a target movement angle inputting section for inputting a target movement angle defined by a target movement direction of the hull with respect to a stem direction of the hull; and a marine vessel running controlling apparatus which controls running of the marine vessel based on the target combined propulsive force input from the target propulsive force inputting section and the target movement angle input from the target movement angle inputting section;

the marine vessel running controlling apparatus including:

a target combined propulsive force acquiring section which acquires the target combined propulsive force input from the target propulsive force inputting section;

a target movement angle acquiring section which acquires the target movement angle input from the target movement angle inputting section;

a steering controlling section which controls the steering angles of the respective steering mechanisms such that a turning angular speed of the hull is substantially equal to a predetermined target angular speed;

a target propulsive force calculating section which calculates target propulsive forces to be generated from the respective propulsion systems based on the target combined propulsive force acquired by the target combined propulsive force acquiring section, the target movement angle acquired by the target movement angle acquiring section and the steering angles of the respective steering mechanisms; and a propulsive force controlling section which controls the respective propulsion systems so as to attain the target propulsive forces calculated by the target propulsive force calculating section.

12. A marine vessel maneuvering supporting system for supporting maneuvering of a marine vessel that includes a pair of propulsion systems which respectively generate propulsive forces on a rear port side and a rear starboard side of a hull, and a pair of steering mechanisms which respectively change steering angles defined by directions of the propulsive forces generated by the respective propulsion systems with respect to the hull, the marine vessel maneuvering supporting system comprising:

a target propulsive force inputting section for inputting a target combined propulsive force to be applied to the hull by the pair of propulsion systems;

a target movement angle inputting section for inputting a target movement angle defined by a target movement direction of the hull with respect to a stem direction of the hull;

a target angular speed inputting section for inputting a target angular speed of the hull;

an angular speed detecting section which detects a turning angular speed of the hull; and a marine vessel running controlling apparatus which controls running of the marine vessel based on the target combined propulsive force input from the target propulsive force inputting section, the target movement angle input from the target movement angle inputting section, the target angular speed input from the target angular speed inputting section and the angular speed detected by the angular speed detecting section;

the marine vessel running controlling apparatus including:

a target combined propulsive force acquiring section which acquires the target combined propulsive force input from the target propulsive force inputting section;

a target movement angle acquiring section which acquires the target movement angle input from the target movement angle inputting section;

a target angular speed acquiring section which acquires the target angular speed input from the target angular speed inputting section;

a steering controlling section which controls the steering angles of the respective steering mechanisms such that the turning angular speed detected by the angular speed detecting section is substantially equal to the target angular speed acquired by the target angular speed acquiring section;

a target propulsive force calculating section which calculates target propulsive forces to be generated from the respective propulsion systems based on the target combined propulsive force acquired by the target combined propulsive force acquiring section, the target movement angle acquired by the target movement angle acquiring section and the steering angles of the respective steering mechanisms; and a propulsive force controlling section which controls the respective propulsion systems so as to attain the target propulsive forces calculated by the target propulsive force calculating section.

13. A marine vessel comprising:

a hull;

a pair of propulsion systems which respectively generate propulsive forces on a rear port side and a rear starboard side of the hull;

a pair of steering mechanisms which respectively change steering angles defined by directions of the propulsive forces generated by the respective propulsion systems with respect to the hull; and a marine vessel running controlling apparatus which controls the pair of propulsion systems and the pair of steering mechanisms;

the marine vessel running controlling apparatus including:

a target combined propulsive force acquiring section which acquires a target combined propulsive force to be applied to the hull by the pair of propulsion systems;

a target movement angle acquiring section which acquires a target movement angle defined by a target movement direction of the hull with respect to a stem direction of the hull;

a steering controlling section which controls the steering angles of the respective steering mechanisms such that a turning angular speed of the hull is substantially equal to a predetermined target angular speed;

a target propulsive force calculating section which calculates target propulsive forces to be generated from the respective propulsion systems based on the target combined propulsive force acquired by the target combined propulsive force acquiring section, the target movement angle acquired by the target movement angle acquiring section and the steering angles of the respective steering mechanisms; and a propulsive force controlling section which controls the respective propulsion systems so as to attain the target propulsive forces calculated by the target propulsive force calculating section.

14. A marine vessel running controlling method for controlling running of a marine vessel that includes a pair of propulsion systems which respectively generate propulsive forces on a rear port side and a rear starboard side of a hull, and a pair of steering mechanisms which respectively change steering angles defined by directions of the propulsive forces generated by the respective propulsion systems with respect to the hull, the method comprising the steps of:

acquiring a target combined propulsive force to be applied to the hull by the pair of propulsion systems;

acquiring a target movement angle defined by a target movement direction of the hull with respect to a stem direction of the hull;

controlling the steering angles of the respective steering mechanisms such that a turning angular speed of the hull is substantially equal to a predetermined target angular speed;

calculating target propulsive forces to be generated from the respective propulsion systems based on the target combined propulsive force, the target movement angle and the steering angles of the respective steering mechanisms; and controlling the respective propulsion systems so as to attain the calculated target propulsive forces.

15. A marine vessel running controlling method as set forth in claim 14, wherein the steering angle controlling step includes the step of determining the target steering angles of the respective steering mechanisms such that action lines along which the propulsive forces are generated by the respective propulsion systems intersect each other on a center line of the hull extending through a stem and a stern of the hull.

16. A marine vessel running controlling method as set forth in claim 15, wherein the steering angle controlling step further includes the step of calculating one of the target steering angles of the steering mechanisms by adding a constant $\phi_c$ to a steering angle correction value $\psi$ ($\psi>0$), calculating the other target steering angle by subtracting the constant $\phi_c$ from the steering angle correction value $\psi$, and locating an action point defined by an intersection of the action lines outside the center line.

17. A marine vessel running controlling method as set forth in claim 14, wherein the propulsion systems each include a motor as a driving source, and the target propulsive force calculating step includes:

a first rotational speed setting step in which a rotational speed of the motor of one of the propulsion systems is determined according to the target combined propulsive force; and a second rotational speed setting step in which a rotational speed of the motor of the other propulsion system is determined according to the rotational speed determined in the first rotational speed setting step, the target movement angle and at least one of the steering angles of the steering mechanisms.

* * * * *